US010984723B1

(12) United States Patent
Zhou et al.

(10) Patent No.: US 10,984,723 B1
(45) Date of Patent: Apr. 20, 2021

(54) PIXEL CIRCUIT AND DRIVE METHOD THEREOF, DISPLAY PANEL, AND DISPLAY DEVICE

(71) Applicant: Wuhan Tianma Micro-Electronics Co., Ltd., Wuhan (CN)

(72) Inventors: Maoqing Zhou, Wuhan (CN); Fei Chen, Wuhan (CN); Dongxu Xiang, Wuhan (CN)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 16/891,476

(22) Filed: Jun. 3, 2020

(30) Foreign Application Priority Data

Jan. 2, 2020 (CN) ..... 202010003245.5

(51) Int. Cl.
*G09G 3/3258* (2016.01)

(52) U.S. Cl.
CPC ..... *G09G 3/3258* (2013.01); *G09G 2310/06* (2013.01); *G09G 2310/061* (2013.01); *G09G 2320/045* (2013.01)

(58) Field of Classification Search
CPC .. G09G 3/3258; G09G 3/3208; G09G 3/3291; G09G 2300/043; G09G 2320/045; G09G 2310/06; G09G 2310/061
See application file for complete search history.

(56) References Cited

U.S. PATENT DOCUMENTS 9,286,834 B2 * 3/2016 Yoon ..... G09G 3/3291
2017/0047007 A1 * 2/2017 Yin ..... G09G 3/325
2019/0114954 A1 * 4/2019 Xuan ..... G09G 3/3233

FOREIGN PATENT DOCUMENTS

CN 107749247 A 3/2018
CN 108122951 A 6/2018
CN 110070825 A 7/2019

OTHER PUBLICATIONS

Chinese Office Action related to Application No. 202010003245.5 dated Oct. 10, 2020.

* cited by examiner

*Primary Examiner* — Sardis F Azongha
(74) *Attorney, Agent, or Firm* — von Briesen & Roper, s.c.

(57) ABSTRACT

Provided are a pixel circuit and a drive method thereof, a display panel and a display device. The pixel circuit includes: a drive transistor, a storage capacitor, a data writing module, a threshold compensation module, and an organic light emitting element. The data writing module is electrically connected to a gate of the drive transistor and a first plate of the storage capacitor, and is configured to write a data signal to the gate of the drive transistor and the first plate of the storage capacitor at a data writing phase. The threshold compensation module is electrically connected to a second plate of the storage capacitor, and is configured to adjust a potential of the second plate of the storage capacitor to a first potential at the data writing phase, and adjust the potential of the second plate of the storage capacitor to a second potential.

20 Claims, 13 Drawing Sheets

PIXEL CIRCUIT AND DRIVE METHOD THEREOF, DISPLAY PANEL, AND DISPLAY DEVICE

CROSS-REFERENCES TO RELATED APPLICATIONS

This application claims priority to Chinese patent application No. CN 202010003245.5 filed at the CNIPA on Jan. 2, 2020, the disclosure of which is incorporated herein by reference in its entirety.

FIELD

The present invention relates to the field of drive techniques and, in particular, to a pixel circuit and drive method thereof, a display panel, and a display device.

BACKGROUND

The Organic Light Emitting Diode (OLED) display has the advantages of self-lamination, low drive voltage, high luminous efficiency, short response time, flexible display, etc., and is a display with the most potential development at present.

An OLED element of the OLED display is a current-driven element, and a corresponding pixel drive circuit needs to be provided to supply a drive current to the OLED element so that the OLED element can emit light. The pixel drive circuit of the OLED display generally includes a drive transistor, a switching transistor, and a storage capacitor, wherein the drive transistor is capable of generating the drive current to drive the OLED element according to a voltage of a gate thereof. However, due to the drive process and device aging, a threshold voltage of the drive transistor in the pixel drive circuit may drift, which causes display non-uniformity.

SUMMARY

Embodiments of the present disclosure provide a pixel circuit and drive method thereof, a display panel, and a display device, to solve the technical problem in the related art, wherein a change in the gate voltage of a drive transistor due to an influence of a leakage currentaffects the luminous brightness of a light emitting element, causes display non-uniformity, and creates a display effect.

In a first aspect, the embodiments of the present disclosure provide a pixel circuit. The pixel circuit includes a drive transistor, a storage capacitor, a data writing module, a threshold compensation module, and an organic light emitting element.

The data writing module is electrically connected to a gate of the drive transistor and a first plate of the storage capacitor, and is configured to write a data signal to the gate of the drive transistor and the first plate of the storage capacitor at a data writing phase.

The threshold compensation module is electrically connected to a second plate of the storage capacitor, and is configured to adjust a potential of the second plate of the storage capacitor to a first potential at the data writing phase, and adjust the potential of the second plate of the storage capacitor to a second potential at a threshold compensation phase, so that a potential of the first plate of the storage capacitor is adjusted to a third potential and a threshold voltage of the drive transistor is compensated, where the second potential is greater than the first potential.

The drive transistor is electrically connected to the organic light emitting element, and is configured to provide a drive current to the organic light emitting element at a light emitting phase to drive the organic light emitting element to emit light.

In a second aspect, the embodiments of the present disclosure provide a drive method of a pixel circuit. The drive method is applied to the above pixel circuit and includes the following steps.

At a data writing phase, a data writing module writes a data signal to each of a gate of a drive transistor and a first plate of a storage capacitor, and a threshold compensation module adjusts a potential of a second plate of the storage capacitor to a first potential.

At a threshold compensation phase, the threshold compensation module adjusts the potential of the second plate of the storage capacitor to a second potential, so that the potential of the second plate of the storage capacitor is raised to the second potential and at least part of a threshold voltage of the drive transistor is compensated, where the second potential is greater than the first potential.

At a light emitting phase, the drive transistor provides a drive current to the organic light emitting element to drive the organic light emitting element to emit light.

In a third aspect, the embodiments of the present disclosure provide a display panel. The display panel includes a display region and a non-display region surrounding the display region. The display region at least includes a first display region, the first display region includes a plurality of first pixel circuits arranged in an array, and the first pixel circuit is the pixel circuit described above.

In a fourth aspect, the embodiments of the present disclosure provide a display device. The display device includes the display panel described above.

DETAILED DESCRIPTION

Figure 1:
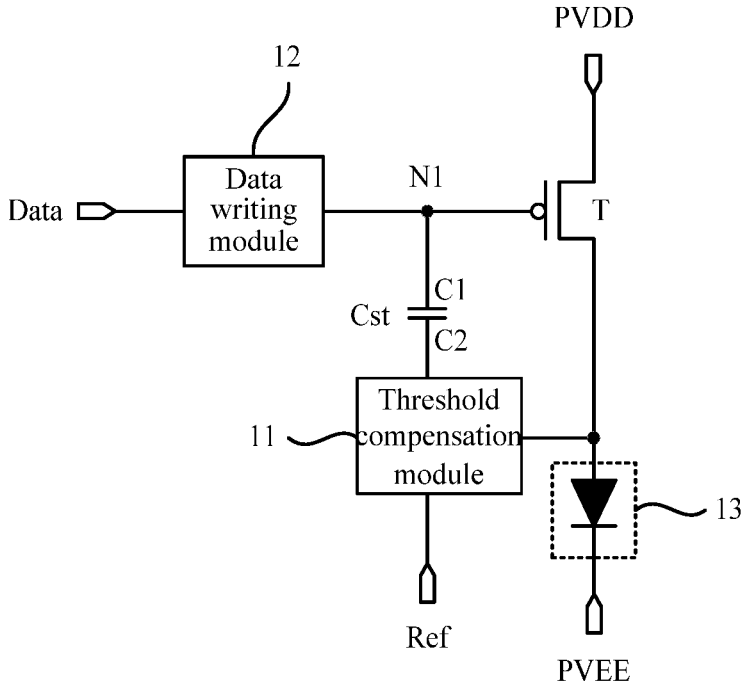
FIG. 1 is a structural diagram of a pixel circuit according to an embodiment of the present disclosure.

Hereinafter the present disclosure will be further described in detail in conjunction with the drawings and embodiments. It is to be understood that the specific embodiments set forth herein are merely intended to illustrate and not to limit the present disclosure. Additionally, it is to be noted that for ease of description, merely part, not all, of the structures related to the present disclosure are illustrated in the drawings.

As mentioned in the BACKGROUND, due to the drive process and device aging, a threshold voltage of the drive transistor in the pixel drive circuit may drift, which causes display non-uniformity. In the related art, a pixel circuit with threshold compensation function has a complex structure and a large size, which is not conducive to the high pixels per inch (PPI) of display panel. At the same time, this pixel circuit cannot satisfy the transmission and display requirements of the high-transmittance region.

In order to solve the above problem, embodiments of the present disclosure provide a pixel circuit. The pixel circuit includes a drive transistor, a storage capacitor, a data writing module, a threshold compensation module, and an organic light emitting element. The data writing module is electrically connected to a gate of the drive transistor and a first plate of the storage capacitor, and is configured to write a data signal to the gate of the drive transistor and the first plate of the storage capacitor at a data writing phase. The threshold compensation module is electrically connected to a second plate of the storage capacitor, and is configured to adjust a potential of the second plate of the storage capacitor to a first potential at the data writing phase, and adjust the potential of the second plate of the storage capacitor to a second potential at a threshold compensation phase, so that a potential of the first plate of the storage capacitor is adjusted to a third potential and a threshold voltage of the drive transistor is compensated, where the second transistor is greater than the first potential. The drive transistor is electrically connected to the organic light emitting element, and is configured to provide a drive current to the organic light emitting element at a light emitting phase to drive the organic light emitting element to emit light.

By adopting the above technical solution, at the data writing phase, the data writing module writes a data signal to the gate of the drive transistor and the first plate of the storage capacitor, and the threshold compensation module adjusts the potential of the second plate of the storage capacitor to the first potential, so that a voltage difference is generated between the first plate and the second plate of the storage capacitor; and at the threshold compensation phase, the threshold compensation module adjusts the potential of the second plate of the storage capacitor to the second potential, and in this case, the second potential of the second plate of the storage capacitor is different from the first potential of the second plate of the storage capacitor at the data writing phase. Due to the characteristic of charge conservation of the storage capacitor, a voltage difference between two ends of the storage capacitor needs to be kept unchanged. Therefore, due to the coupling effect of the storage capacitor, when the potential of the second plate of the storage capacitor is increased from the first potential to the second potential, the potential of the first plate of the storage capacitor will be changed along with the change of the potential of the second plate of the storage capacitor. In this case, when the potential of the second plate of the storage capacitor is adjusted to the second potential, the potential of the first plate of the storage capacitor is hence adjusted to a third potential, where the third potential may include the data signal written at the data writing phase and the threshold voltage of the drive transistor, to perform threshold compensation on the drive transistor, so that when the drive transistor provides a drive current to the light emitting element at the light emitting phase, the influence of the threshold voltage drift of the drive transistor on the luminous brightness of the light emitting element can be reduced. The embodiments of the present disclosure can improve the display non-uniformity caused by the threshold drift of the drive transistor, thereby improving the display effect; meanwhile, the pixel circuit provided by the embodiments of the present disclosure has a simple structure with a smaller size, facilitating the improvement of the resolution of the display panel or the increase of the area of a high-transmittance region in the display panel.

The above is the core idea of the present disclosure. Based on the embodiments of the present disclosure, all other embodiments obtained by those skilled in the art without creative work are within the scope of the present disclosure. Technical solutions presented in embodiments of the present disclosure are described clearly and completely in conjunction with the drawings of the embodiments of the present disclosure.

FIG. 1 is a structural diagram of a pixel circuit according to an embodiment of the present disclosure. As shown in FIG. 1, the pixel circuit includes a drive transistor T, a storage capacitor Cst, a data writing module 12, a threshold compensation module 11, and an organic light emitting element 13. The data writing module 12 is electrically connected to a gate of the drive transistor T and a first plate C1 of the storage capacitor Cst. The data writing module 12 is configured to write a data signal Vdata to the gate of the drive transistor T and the first plate C1 of the storage capacitor Cst at a data writing phase. The threshold compensation module 11 is electrically connected to a second plate C2 of the storage capacitor T. The threshold compensation module 11 adjusts a potential of the second plate C2 of the storage capacitor Cst to a first potential V1 at the data writing phase, and adjusts the potential of the second plate C2 of the storage capacitor Cst to a second potential V2 at the threshold compensation phase, where the second potential V2 is different from the first potential V1, so that a potential of the first plate C1 of the storage capacitor Cst is adjusted to a third potential V3. In this case, a gate potential of the drive transistor T, electrically connected to the first plate C1 of the storage capacitor Cst, is also adjusted to the third potential V3, to compensate a threshold voltage of the drive transistor T. The drive transistor T is electrically connected to the organic light emitting element 13. After the threshold compensation, the drive transistor T can provide a drive current to the organic light emitting element 13 at the light emitting phase to drive the organic light emitting element 13 to emit light.

On this basis, the pixel circuit may further include a data signal terminal for receiving the data signal Vdata, a first reset signal terminal Ref for receiving a first reset signal Vref1, a power signal terminal PVDD for receiving a power signal Vdd, a low voltage signal terminal PVEE for receiving a logic low-level signal Vee, and a first node N1 for electrically connecting the data writing module 12, the drive transistor T and the storage capacitor Cst.

Specifically, at the data writing phase, the data writing module 12 and the threshold compensation module 11 are turned on. The data signal Vdata of the data signal terminal Data can be written to the gate of the drive transistor T and the first plate C1 of the storage capacitor Cst through the data writing module 12. Meanwhile, the first reset signal Vref1 of the first reset signal terminal Ref can adjust the potential of the second plate C2 of the storage capacitor Cst to the first potential V1 through the threshold compensation module 11, where the first potential V1 may include threshold information of the drive transistor T, so that a voltage difference is generated between the first plate C1 and the second plate C2 of the storage capacitor Cst. At the threshold compensation phase, the data writing module 12 is turned off. The first reset signal Vref1 of the first reset signal terminal Ref is reversed. The threshold compensation module 11 continues to be turned on. The data signal of the data signal terminal Data is no longer written to the gate of the drive transistor T and the first plate of the storage capacitor Cst through the data writing module 12. In this case, the reversed first reset signal Vref1 is different from the first reset signal Vref1 at the data writing phase. When the reversed first reset signal Vref1 is written to the second plate C2 of the storage capacitor Cst through the threshold compensation module 11, the potential of the second plate C2 of the storage capacitor Cst is adjusted from the first potential to the second potential V2. The second potential V2 is different from the first potential V1 at the data writing phase, and the second potential V2 may be equal to the potential of the reversed first reset signal Vref1. In this case, the second potential of the second plate C2 of the storage capacitor Cst is increased by (V2−V1).

The capacitor has the characteristic of charge conservation, that is, after two plates of the storage capacitor Cst are fully charged, the voltage difference generated between two plates of the storage capacitor Cst will be kept unchanged. If the potential of one of the plates of the storage capacitor Cst changes, the potential of the other plate of the storage capacitor Cst can be changed due to the coupling effect. Therefore, at the end of the data writing phase, the potential of the first plate C1 of the storage capacitor Cst is the potential of the data signal Vdata, the potential of the second plate C2 of the storage capacitor Cst is the first potential V1, and in this case, the potential difference between the first plate C1 and the second plate C2 of the storage capacitor Cst is (Vdata−V1). At the threshold compensation phase, when the potential of the second plate C2 of the storage capacitor Cst is adjusted to the second potential V2, the potential of the second plate C2 of the storage capacitor Cst is increased by (V2−V1). In order to keep the potential difference between the two plates of the storage capacitor Cst as the potential difference (Vdata−V1) at the end of the data writing phase, the potential of the first plate C1 of the storage capacitor Cst should also be increased by (V2−V1). In this case, the potential of the first plate C1 of the storage capacitor Cst is adjusted to the third potential V3, and the third potential V3 is equal to (Vdata+V2−V1). Since the first plate C1 of the storage capacitor Cst and the gate of the drive transistor T are electrically connected to the first node N1, the gate potential of the drive transistor T is the same as that of the first plate C1 of the storage capacitor Cst, that is, the gate potential of the drive transistor T after threshold compensation is, (Vdata+V2−V1).

In addition, the drive transistor T is further electrically connected to the power signal terminal PVDD and an anode of the organic light emitting element 13. A cathode of the organic light emitting element 13 is electrically connected to the logic low-level signal terminal PVEE.

The power signal terminal PVDD is configured to provide the power signal Vdd. The logic low-level signal terminal PVEE is configured to provide the logic low-level signal Vee to form a current loop when the drive transistor T provides the drive current to the organic light emitting element 13. When (V2−V1) includes the threshold information of the drive transistor T, a drive current $I_{ds}$ provided by the drive transistor T to the organic light emitting element 13 is as follows.

$$I_{ds} = \frac{W}{2L}\mu C_{ox}(Vdata + V2 - V1 - Vdd - Vth1)^2$$

In the above formula, W/L is the width-to-length ratio of the drive transistor T, $C_{ox}$ is the capacitance per unit area of the gate oxide in the drive transistor, and μ is the carrier mobility in the drive transistor T. When the gate potential (Vdata+V2−V1) of the drive transistor T includes the threshold voltage of the drive transistor T, the drive current provided by the drive transistor T to the organic light emitting element 13 at the light emitting phase may be independent of the threshold voltage of the drive transistor T, thereby reducing the display non-uniformity caused by the threshold voltage fluctuation of the drive transistor T and improving the display effect.

At the same time, the pixel circuit provided by the embodiments of the present disclosure compensates the threshold voltage of the drive transistor T on the basis of the fact that the storage capacitor Cst has the characteristic of charge conservation. In such a way, the threshold compensation for the drive transistor T can be implemented without a complex compensation circuit. Compared with the pixel circuit with a threshold compensation function in the related art, the pixel circuit provided in the embodiments of the present disclosure has a simple structure and a smaller size. When the pixel circuit is applied to the display panel, the resolution of the display panel can be improved, or in the condition that the resolution of the display panel remains unchanged, the area of the high-transmittance region in the display panel can be increased.

In addition, since the first plate C1 of the storage capacitor Cst and the gate of the drive transistor T are electrically connected to the first node N1, the storage capacitor Cst reuses the gate of the drive transistor T. For example, the first plate C1 of the storage capacitor Cst and the gate of the drive transistor T may be disposed in the same layer, and integrated with each other, so that no trace is required between the storage capacitor Cst and the gate of the drive transistor T. Therefore, the circuit can be further simplified and the size of the circuit can be reduced, thereby further improving the resolution of the display panel, or further increasing the area of the high-transmittance region in the display panel.

It is to be noted that the specific structure of the data writing module and the threshold compensation module is not specifically limited in the embodiments of the present disclosure. Under the condition that the threshold voltage of the drive transistor can be compensated by adopting the coupling effect of the storage capacitor, each of the modules of the pixel circuit can be designed according to the actual need.

Figure 2:
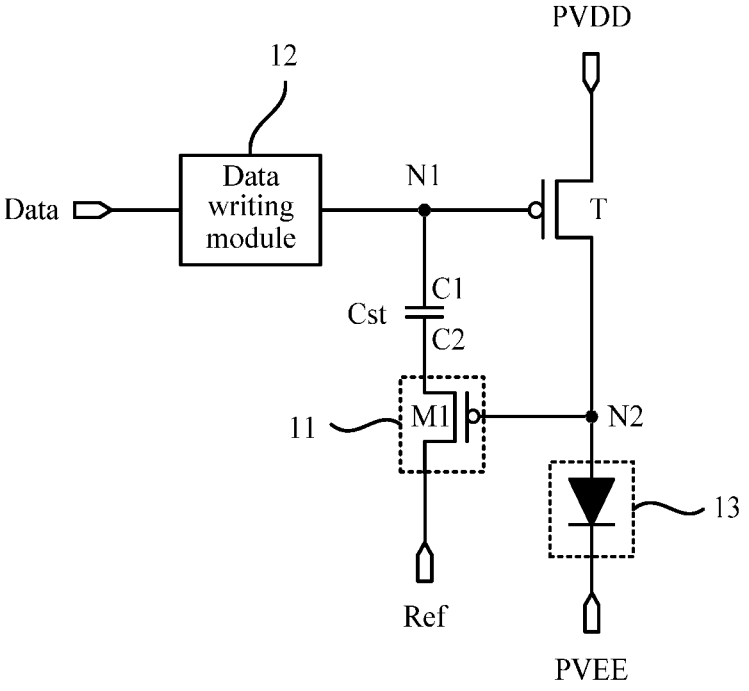
FIG. 2 is a structural diagram of another pixel circuit according to an embodiment of the present disclosure.

Optionally, FIG. 2 is a structural diagram of another pixel circuit according to an embodiment of the present disclosure. As shown in FIG. 2, the threshold compensation module 11 may include a first transistor M1. A threshold voltage Vth2 of the first transistor M1 is a first threshold voltage. The potential difference between the first potential V1 on the second plate C2 of the storage capacitor Cst at the data writing phase and the second potential V2 on the second plate C2 of the storage capacitor Cst at the threshold compensation phase at least includes the first threshold voltage Vth2 of the first transistor M1.

Specifically, a first electrode of the first transistor M1 may be electrically connected to the first reset signal terminal Ref to receive the first reset signal Vref1 of the first reset signal terminal Ref. A second electrode of the first transistor M1 is electrically connected to the second plate C2 of the storage capacitor Cst, and a gate of the first transistor M1 is electrically connected to the anode (second node N2) of the organic light emitting element 13. In such a way, at the data writing phase, when the potential difference between the second node N2 and the second plate C2 of the storage capacitor Cst satisfies a conduction condition of the first transistor M1, the first transistor M1 is turned on, so that the first reset signal Vref1 of the first reset signal terminal Ref adjusts the potential of the second plate of the storage capacitor Cst through the turned-on first transistor M1. When the potential difference between the second node N2 and the second plate C2 of the storage capacitor Cst does not satisfy the conduction condition of the first transistor M1, the first transistor M1 is turned off. When the logic low-level signal received by the cathode of the organic light emitting element 13 is Vee and the potential difference between the anode and cathode of the organic light emitting element 13 is Voled, the potential of the second node N2 is (Vee+Voled). Since a critical point for turning off the first transistor M1 occurs when the potential difference of the second plate C2 of the storage capacitor Cst and the second node N2 is the threshold voltage Vth2 of the first transistor M1, at the end of the data writing phase, the potential of the second plate C2 of the storage capacitor Cst can be adjusted to the first potential V1=Vee+Voled−Vth2. At the threshold compensation phase, when the first reset signal Vref1 of the first reset signal terminal Ref is at the logical high-level state, and the potential difference between the first reset signal Vref1 at the logical high-level state and the second node N2 satisfies the conduction condition of the first transistor M1, the first reset signal Vref1 at the logical high-level state is written into the second plate C2 of the storage capacitor Cst through the turned-on first transistor M1, so that the potential of the second plate C2 of the storage capacitor Cst can be adjusted to the second potential V2. In this case, the potential of the second plate C2 of the storage capacitor Cst is ΔV=V2−Vee−Voled+Vth2 higher than that at the end of the data writing phase. Due to the coupling effect of the storage capacitor Cst, the potential of the first plate C1 of the storage capacitor Cst is also increased. In this case, the potential of the first plate C1 of the storage capacitor Cst is adjusted to the third potential V3=Vdata+ΔV, that is, the gate potential of the drive transistor T is adjusted to the third potential V3=Vdata+V2−Vee−Voled+Vth2, that is, the third potential V3 includes the threshold voltage of the first transistor M3.

In such a way, in the circuit design, the first transistor M1 can be disposed close to the drive transistor T, so that the threshold voltage Vth2 of the first transistor M1 has the same trend as the threshold voltage Vth1 of the drive transistor T. In this case, the difference between the threshold voltage Vth2 of the first transistor M1 and the threshold voltage Vth1 of the drive transistor T can be a fixed value. At the data writing phase, when the data signal Vdata is written into the gate of the drive transistor T, the data signal Vdata can include a data voltage corresponding to the display gray scale value and the difference between the threshold voltage Vth2 of the first transistor M1 and the threshold voltage Vth1 of the drive transistor T, so that when the potential difference between the first potential V1 and the second potential V2 includes the threshold voltage Vth2 of the first transistor M1, the threshold compensation for the drive transistor T can be achieved, improving the display luminescence effect of the pixel.

Alternatively, when the first transistor M1 is disposed close to the drive transistor T, the difference between the threshold voltage Vth2 of the first transistor M1 and the threshold voltage Vth1 of the drive transistor T may be within a preset range, so that after the threshold compensation, the influence of the difference between the threshold voltage Vth2 of the first transistor M1 and the threshold voltage Vth1 of the drive transistor T on the drive current can be ignored, and the threshold compensation can also be performed on the drive transistor T, thereby improving the display luminescence effect of the pixel.

Exemplarily, an active layer of the first transistor M1 may include a first channel, an active layer of the drive transistor T may include a second channel, and the distance W between the first channel and the second channel may satisfy the condition that: 2.5 micron (μm)≤W≤4.5 ƒm. In such a way, under the condition of satisfying the process design, it is possible to make the first transistor M1 and the drive transistor T have a closer distance, so that the threshold compensation on the drive transistor T can be achieved when the third potential V3 includes the threshold voltage Vth2 of the first transistor M1.

Figure 3:
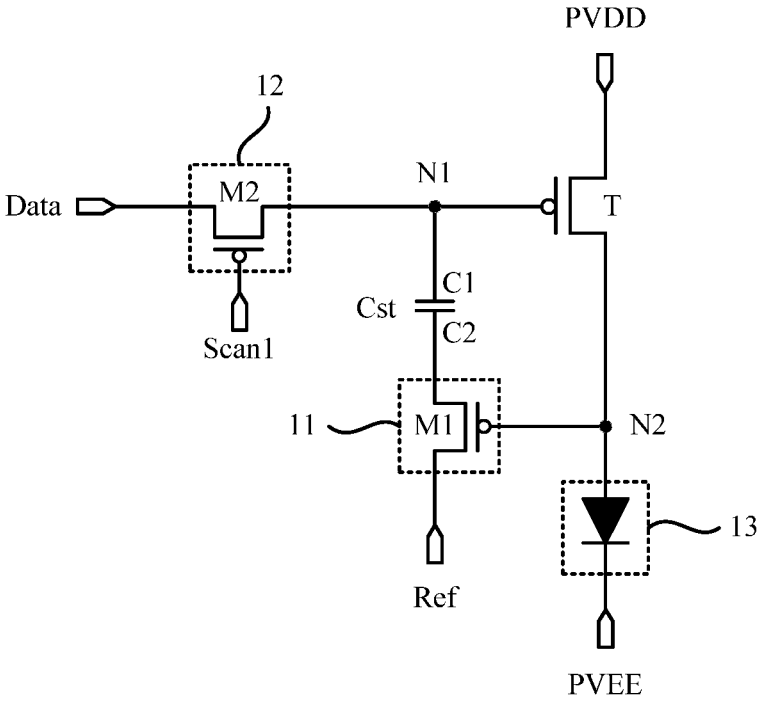
FIG. 3 is a specific circuit structural diagram of a pixel circuit according to an embodiment of the present disclosure.

Optionally, FIG. 3 is a specific circuit structural diagram of a pixel circuit according to an embodiment of the present disclosure. As shown in FIG. 3, the threshold compensation module 11 of the pixel circuit may include a first transistor M1, and the data writing module 12 may include a second transistor M2. The first electrode of the first transistor M1 receives the first reset signal Vref, the second electrode of the first transistor M1 is electrically connected to the second plate C2 of the storage capacitor Cst, and the gate of the first transistor M1 is electrically connected to the anode of the organic light emitting element 13. The first electrode of the second transistor M2 receives the data signal Vdata, the second electrode of the second transistor M2 is electrically connected to the gate of the drive transistor T and the first plate of the storage capacitor Cst, and the gate of the second transistor M2 receives a first scanning signal S1. The first electrode of the drive transistor T receives the power signal Vdd, and the second electrode of the drive transistor T is electrically connected to the anode of the organic light emitting element 13. The cathode of the organic light emitting element 13 receives the logic low-level signal Vee.

Specifically, the gate of the second transistor M2 is electrically connected to a first scanning signal terminal Scan1. The first scanning signal S1 of the first scanning signal terminal Scan1 can control the conduction and disconnection of the second transistor M2, that is, the first scanning signal S1 of the first scanning signal terminal Scan1 can control the second transistor M2 to turn on at the data writing phase and turn off at other phases, so that the data signal Vdata of the data signal terminal Data can be written into the first node N1 through the turned-on second transistor M2, so that the potential of the gate of the drive transistor T and the potential of the first plate C1 of the storage capacitor Cst are the potential of the data signal Vdata.

The first electrode of the first transistor M1 is electrically connected to the first reset signal terminal Ref, the gate of the first transistor M1 is electrically connected to the anode (second node N2) of the organic light emitting element 13, and the first reset signal Vref1 of the first reset signal terminal Ref and the anode potential of the organic light emitting element 13 can together control the conduction and disconnection of the first transistor M1. Since the cathode of the organic light emitting element 13 is electrically connected to the logic low-level signal terminal PVEE which provides a fixed logic low-level signal Vee to the organic light emitting element 13, the anode potential of the organic light emitting element 13 should be the sum of the logic low-level signal Vee and the potential difference Voled at both terminals of the organic light emitting element 13, that is, the potential of the second node N2 is (Vee+Voled). In such a way, at the data writing phase, when the potential difference between the potential of the second node N2 and an initial potential of the second plate C2 of the storage capacitor Cst satisfies the conduction condition of the first transistor M1, the first transistor M1 can be in the on-state, so that the first reset signal Vref1 of the first reset signal terminal Ref adjusts the potential of the second plate C2 of the storage capacitor Cst through the turned-on first transistor M1. If the threshold voltage of the first transistor M1 is Vth2, when the first reset signal Vref1 adjusts the potential of the second plate C2 of the storage capacitor Cst to (Vee+Ved−Vth2), that is the critical point for turning on the first transistor M1, that is, at the data writing phase, the potential of the second plate C2 of the storage capacitor Cst is the first potential V1=Vee+Ved−Vth2. By reversing the first reset signal Vref1 received by the first electrode of the first transistor M1 at the threshold compensation phase and making the potential difference between the second node N2 and the first reset signal Vref1 in this case satisfy the conduction condition of the first transistor M1, the first transistor M1 can be turned on at the threshold compensation phase. In this case, the first reset signal Vref1 of the first reset signal terminal Ref can be written into the second plate C2 of the storage capacitor Cst through the turned-on first transistor M1, so that the potential of the second plate C2 of the storage capacitor Cst becomes the second potential V2, and the potential of the second plate C2 of the storage capacitor Cst increases by (V2−Vee−Ved+Vth2). Due to the coupling effect of the storage capacitor Cst, the potential of the first plate C1 of the storage capacitor Cst increases with the increase of the potential of the second plate C2, and the potential of the first plate C1 of the storage capacitor Cst is adjusted to the third potential V3, that is, the gate potential of the drive transistor T is the third potential V3 which satisfies the following formula: V3=Vdata+V2−Vee−Voled−Vth2.

In such a way, when the threshold voltage Vth2 of the first transistor M1 is approximately equal to the threshold voltage Vth1 of the drive transistor T, the influence of the threshold voltage of the drive transistor T on the drive current provided by the drive transistor T to the organic light emitting element 13 at the light emitting phase can be ignored, so that threshold compensation on the drive transistor T can be achieved, thereby improving pixel display uniformity.

Exemplarily, when the second transistor M2 is a P-type transistor, the P-type transistor is turned on when the first scanning signal S1 of the first scanning signal terminal Scan1 is a logic low-level signal, and is turned off when the first scanning signal S1 of the first scanning signal terminal Scan1 is a logical high-level signal; when the second transistor M2 is an N-type transistor, the N-type transistor is turned on when the first scanning signal S1 of the first scanning signal terminal Scan1 is a logical high-level signal, and is turned off when the first scanning signal S1 of the first scanning signal terminal Scan1 is a logic low-level signal.

Meanwhile, when the first transistor M1 is a P-type transistor, the P-type transistor is turned on when the potential difference between the second node N2 and the first reset signal Vref1 of the first reset signal terminal Ref or the second plate C2 of the storage capacitor Cst is smaller than the threshold voltage Vth2 of the first transistor M1, and is turned off when the potential difference between the second node N2 and the first reset signal Vref1 of the first reset signal terminal ref or the second plate C2 of the storage capacitor Cst is greater than the threshold voltage Vth2 of the first transistor M1. When the first transistor M1 is an N-type transistor, the N-type transistor is turned on when the potential difference between the second node N2 and the first reset signal Vref1 of the first reset signal terminal Ref or the second plate C2 of the storage capacitor Cst is greater than the threshold voltage Vth2 of the first transistor M1, and is turned off when the potential difference between the second node N2 and the first reset signal Vref1 of the first reset signal terminal ref or the second plate C2 of the storage capacitor Cst is less than the threshold voltage Vth2 of the first transistor M1.

Figure 4:
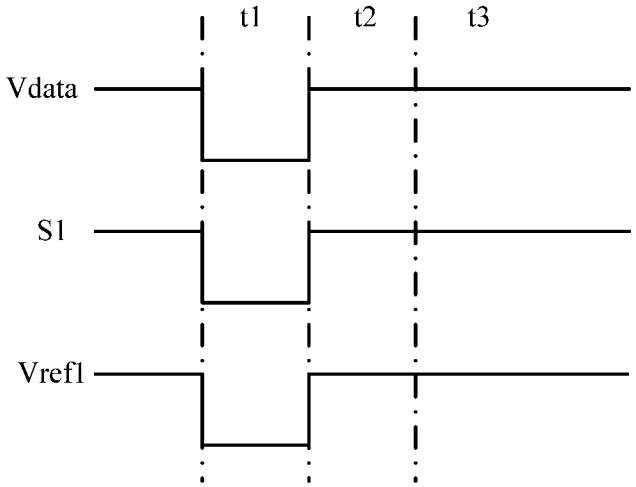
FIG. 4 is a drive timing graph of a pixel circuit according to an embodiment of the present disclosure.

Exemplarily, FIG. 4 is a drive timing graph of a pixel circuit according to an embodiment of the present disclosure. With reference to FIGS. 3 and 4, the threshold compensation module 11 includes a first transistor M1, and the data writing module includes a second transistor M2. When the first transistor M1, the second transistor M2 and the drive transistor T are P-type transistors, the working process of the pixel circuit includes phases as follows.

At phase t1, that is, at the data writing phase, the first scanning signal S1 of the first scanning signal terminal Scant controls the second transistor M2 to be turned on. The first reset signal Vref1 of the first reset signal terminal Ref is a logic low-level signal, and the first reset signal Vref1 at the logical low-level state is less than the potential of the second plate C2 of the storage capacitor Cst. The second electrode of the first transistor M1 electrically connected to the second plate C2 of the storage capacitor Cst may be used as a source of the first transistor M1, and the first electrode of the first transistor M1 electrically connected to the first reset signal Ref may be used as a drain of the first transistor M1. In this case, when the potential difference between the potential (Vee+Voled) of the second node N2 and the second plate C2 of the storage capacitor Cst is less than the absolute value of the threshold voltage Vth2 of the first transistor M1, the first transistor M1 is in the on-state. The data signal Vdata of the data terminal Data is written into the first node N1 through the turned-on second transistor M2, so that the potential of the first electrode plate C1 of the storage capacitor Cst and the potential of the gate of the drive transistor T are both Vdata. At the same time, when the first reset signal Vref1 of the first reset signal terminal Ref is a logic low-level signal, the potential of the second plate C2 of the storage capacitor Cst is pulled down by the first reset signal Vref at the logical low-level state until the potential difference between the second node N2 and the second plate C2 of the storage capacitor Cst is greater than or equal to Vth, and the first transistor M1 is turned off, that is, the potential of the second plate C2 of the storage capacitor Cst is adjusted to the first potential V1 which satisfies the following formula: V1=Vee+Voled−Vth2.

In such a way, at the end of the data writing phase, the potential difference between the first plate C1 and the second plate C2 of the storage transistor Cst will be kept as (Vdata−V1).

At phase t2, that is, at the threshold compensation phase, the first scanning signal S1 of the first scanning signal terminal Scant controls the second transistor M2 to be turned off. The first reset signal Vref1 of the first reset signal terminal Ref becomes a logical high-level signal, and the first reset signal Vref1 at the logical high-level state is greater than the first potential V1 of the second plate C2 of the storage capacitor Cst, so that the first electrode of the first transistor M1 is the source of the first transistor M1, and the second electrode of the first transistor M1 is the drain of the first transistor M1. In this case, the potential difference between the potential (Vee+Voled) of the second node N2 and the first reset signal Vref1 at the logical high-level state is less than the threshold voltage Vth2 of the first transistor M1, so that the first transistor M1 is turned on again. At the same time, the first reset signal Vref1 at the logical high-level state is written into the second plate C2 of the storage capacitor Cst through the turned-on first transistor M1, so that the potential of the second plate C2 of the storage capacitor Cst is adjusted to the second potential V2 which is greater than the first potential V1. In this case, the potential of the second plate C2 of the storage capacitor Cst is increased by ΔV satisfying the following formula: ΔV=V2−Vee−Voled+Vth2.

Due to the characteristic of charge conservation of the capacitor, when the potential of the second plate C2 of the storage capacitor Cst is increased by ΔV, the potential of the first plate C1 of the storage capacitor Cst is also increased by ΔV because of the coupling effect, that is, the potential of the first plate C1 of the storage capacitor Cst is adjusted to the third potential V3 satisfying the following formula: V3=Vdata+V2−Vee−Voled+Vth2.

At phase t3, that is, at the light emitting phase, the potential of the first plate of the storage capacitor Cst remains as the third potential V3, that is, the gate potential of the drive transistor T is the third potential V3, and the drive current Ids generated by the drive transistor T according to its gate potential V3 is as follows.

$$I_{ds} = \frac{W}{2L}\mu C_{ox}(Vdata + V2 - Vee - Voled + Vth2 - Vdd - Vth1)^2.$$

If the threshold voltage Vth2 of the first transistor M1 is approximately equal to the threshold voltage Vth1 of the drive transistor T, it can be considered that the drive current $I_{ds}$ generated by the drive transistor T at the light emitting phase is independent of the threshold voltage of the drive transistor, thereby implementing the threshold compensation and improving the display luminescence effect of the pixel.

In addition, at the data writing phase, the first transistor M1 can be in the on-state only when the potential difference between the second node N2 and the second plate C2 of the storage capacitor Cst is less than the threshold voltage Vth2 of the first transistor M1; at the previous threshold compensation phase of the pixel circuit, the first reset signal at the logical high-level state is written into the second plate C2 of the storage capacitor Cst, which makes the second plate C2 of the storage capacitor Cst have a higher potential, thereby ensuring that the potential difference between the second node N2 and the second plate C2 of the storage capacitor Cst is less than the threshold voltage Vth2 of the first transistor M1, so that the first transistor M1 is turned on. Therefore, the pixel circuit provided in the embodiments of the present disclosure can use the signal written into the storage capacitor Cst at the previous drive cycle, which can implement data write and threshold compensation in the next drive cycle without any extra initialization process, thereby reducing the time required by one drive cycle, simplifying the drive process, increasing the refresh frequency and improving the display effect.

Figure 5:
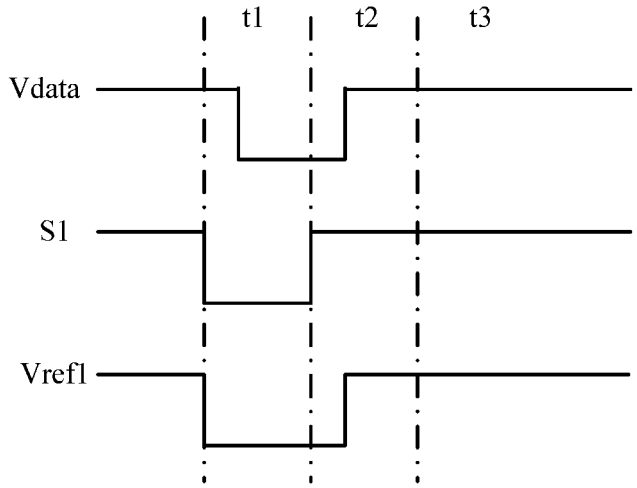
FIG. 5 is a drive timing graph of another pixel circuit according to an embodiment of the present disclosure.

Exemplarily, FIG. 5 is a drive timing graph of another pixel circuit according to an embodiment of the present disclosure. For similarities between FIG. 5 and FIG. 4, reference may be made to the description of FIG. 4, which will not be described herein, and only differences between FIG. 5 and FIG. 4 will be described herein. With reference to FIGS. 3 and 5, at the start of the data writing phase t1, when the first scanning signal S1 of the first scanning signal terminal Scant becomes a logic low-level signal, the second transistor M2 starts to be turned on. In this case, the data signal Vdata corresponding to the display gray scale value is not directly written into the gate of the drive transistor T. Instead, the data signal Vdata at the logical high-level state is written into the gate of the drive transistor T, so as to prevent the turned-on drive transistor T from pulling the potential of the second node N2 up, because that will make the potential difference between the second node N2 and the second plate C2 of the storage capacitor Cst fail to satisfy the conduction condition of the first transistor M1. That is, at the start of the data writing phase, the data signal Vdata at the logical high-level state is written into the gate of the drive transistor T, which ensures that the first transistor M1 is turned on when it enters the data writing phase, so that the first reset signal Vref1 at the logical low-level state can adjust the potential of the second plate C2 of the storage capacitor Cst to the first potential V1. At the same time, at the start of the threshold compensation phase t2, when the first scanning signal S1 of the first scanning signal terminal Scant is reversed to a logical high-level signal, the second transistor M2 starts to be turned off. The data signal Vdata of the data signal terminal Data remains as the data voltage corresponding to display gray scale value, and the first reset signal Vref1 of the first reset signal terminal Ref remains as a logic low-level signal, so as to prevent the second transistor M2 from being turned off completely. The data signal Vdata of the data signal terminal Data and the first reset signal Vref1 of the first reset signal terminal Ref are reversed, which affects the potentials of the two plates of the storage capacitor Cst and thus affects the threshold compensation result. In such a way, the threshold compensation effect can be improved by controlling the write time point of the data signal Vdata corresponding to the display gray scale value of the data signal terminal Data, and by controlling the reverse time point of the data signal Vdata corresponding to the display gray scale value of the data signal terminal Data and the reverse time point of the first reset signal Vref1 of the first reset signal terminal Ref, thereby further improving the pixel display effect.

It is to be noted that FIGS. 4 and 5 in the embodiments of the present disclosure are only drive timing graphs when the transistors in the pixel circuit are P-type transistors. In general, the P-type transistor is turned on under the control of the logic low-level signal and is turned off under the control of the logical high-level signal. In some optional embodiments, the transistors in the pixel circuit may also be N-type transistors. In general, the N-type transistor is turned on under the control of the logical high-level signal and is turned off under the control of the logic low-level signal. The type of each transistor in the pixel circuit will not be specifically limited in the embodiments of the present disclosure.

Figure 6:
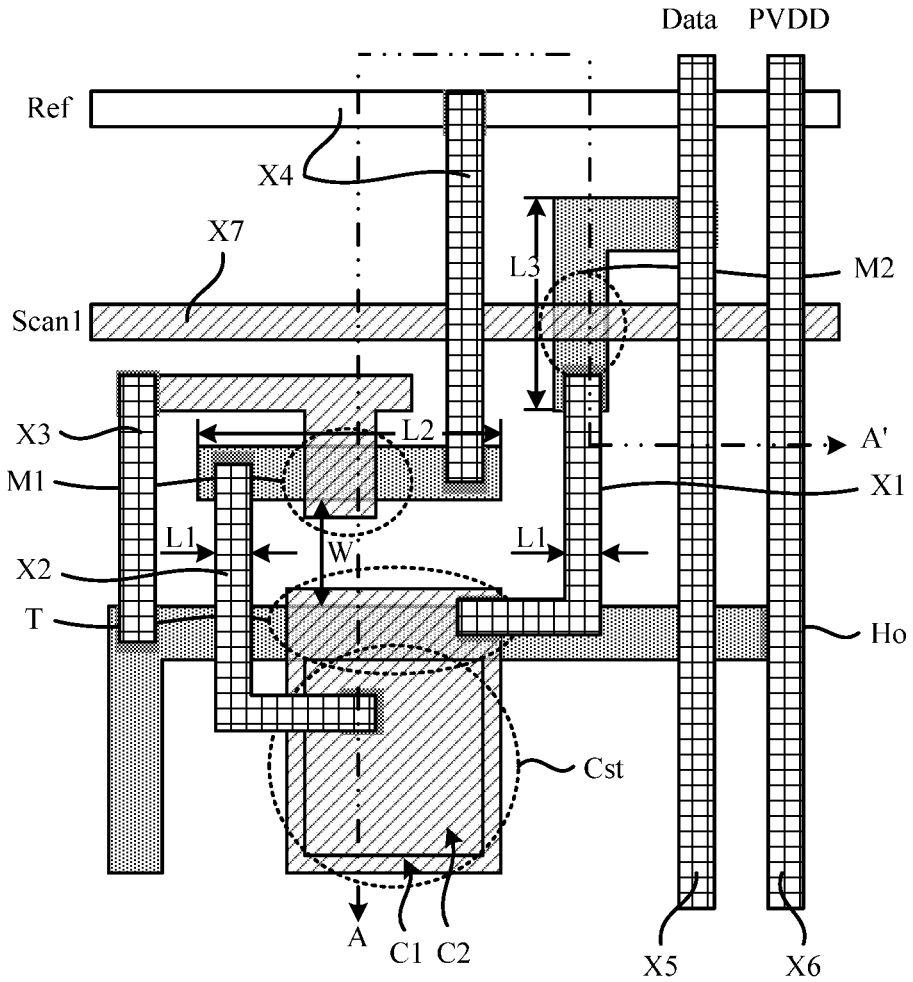
FIG. 6 is a top view of a pixel circuit according to an embodiment of the present disclosure.
Figure 7:
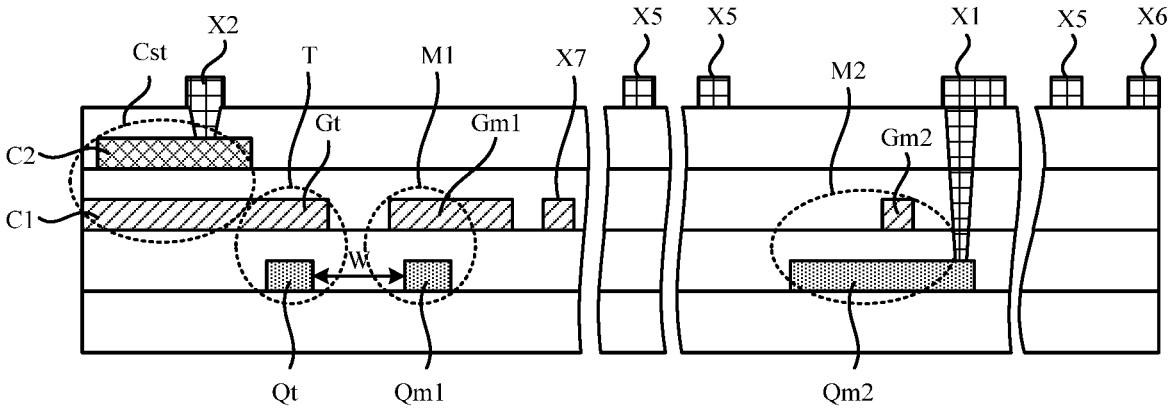
FIG. 7 is a sectional view of the pixel circuit shown in FIG. 6 taken along a section line of A-A'.

Optionally, FIG. 6 is a top view of a pixel circuit according to an embodiment of the present disclosure, and FIG. 7 is a sectional view of the pixel circuit shown in FIG. 6 taken along a section line of A-N. With reference to FIGS. 3, 6 and 7, the pixel circuit further includes connection traces X1 and X2. The connection trace X1 is used for connecting the second transistor M2 and the storage capacitor Cst, and the connection trace X2 is used for connecting the first transistor M1 and the storage capacitor Cst. The width L1 of each of the connection traces X1 and X2 satisfies that 1.5 μm≤L1≤2.5 μm. At the same time, the maximum extension length L2 of a vertical projection of the first transistor M1 on a reference plane satisfies that L2≤3 μm, and the maximum extension length L3 of a vertical projection of the second transistor M2 on the reference plane satisfies that L3≤3 μm, where the reference plane is parallel to the plane where the active layer Sm1 of the first transistor M1 is located. In such a way, the design size of the pixel circuit can be further reduced by setting the connection traces X1 and X2 in the pixel circuit and the first transistor M1 and the second transistor M2 with a smaller size, thereby increasing the transmission intensity of the high-transmittance region when the pixel circuit is applied to the pixels in the high-transmittance region of the display panel.

The pixel circuit may further include connection traces X3, X4, X5, X6 and X7. The connection trace X6 is used for connecting the first electrode of the drive transistor T and the power signal terminal PVDD, the connection trace X3 is used for connecting the second electrode of the drive transistor T and the organic light emitting element 13 and further connecting the first transistor T and the organic light emitting element 13, the connection trace X4 is used for connecting the first transistor M1 and the first reset signal terminal Ref, the connection trace X5 is used for connecting the second transistor M2 and the data signal terminal Data, and the connection trace X7 is used for connecting the second transistor M2 and the first scanning signal terminal Scant. In the embodiments of the present disclosure, under the condition that the threshold compensation condition is satisfied, the width of each of the connection traces X3, X4, X5, X6 and X7 may be the same as the width of the connection traces X1 and X2, so that the pixel circuit can have a smaller design size.

In addition, as shown in FIG. 7, the pixel circuit provided by the embodiments of the present disclosure may include a base substrate as well as a semiconductor layer located on one side of the base substrate, a first metal layer, a second metal layer, a third metal layer, and an insulating layer between each of the semiconductor layer, the first metal layer, the second metal layer and the third metal layer. The semiconductor layer includes an active layer St of the drive transistor T, an active layer Qm1 of the first transistor M1 and an active layer Qm2 of the second transistor M2. The first metal layer includes the gate Gt of the drive transistor T, the gate Gm1 of the first transistor M1, the gate Gm2 of the second transistor M2, the first plate C1 of the storage capacitor Cst and the connection traces X7 and X4, and the first plate C1 of the storage capacitor Cst is integrated with the gate Gt of the drive transistor T. The second metal layer includes the second plate C2 of the storage capacitor Cst. The third metal layer includes connection traces X1, X2, X3, X4, X5 and X6. The different layers of the pixel circuit may be interconnected through via holes Ho. Correspondingly, the channel of the drive transistor T may be an overlapping region between the active layer Qt and the gate Gt of the drive transistor T, and the channel of the first transistor M1 may be an overlapping region between the active layer Sm1 and the gate Gm1 of the first transistor M1. The channel of the first transistor M1 can be parallel to the channel of the drive transistor T, and the distance W between the channel of the first transistor M1 and the channel of the drive transistor T can be made to satisfy that 2.5 μm≤W≤4.5 μm.

It is to be noted that in the embodiments of the present disclosure, the width of the connection trace is not the size of the connection trace in the signalling direction, but the size of the short side of the connection trace, and the size of the long side of the connection trace is related to the position of the components connected by the connection trace, which is not specifically limited in the embodiments of the present disclosure. At the same time, FIG. 7 only illustrates an exemplary layer relationship, and is not intended to limit the embodiments of the present disclosure.

Figure 8:
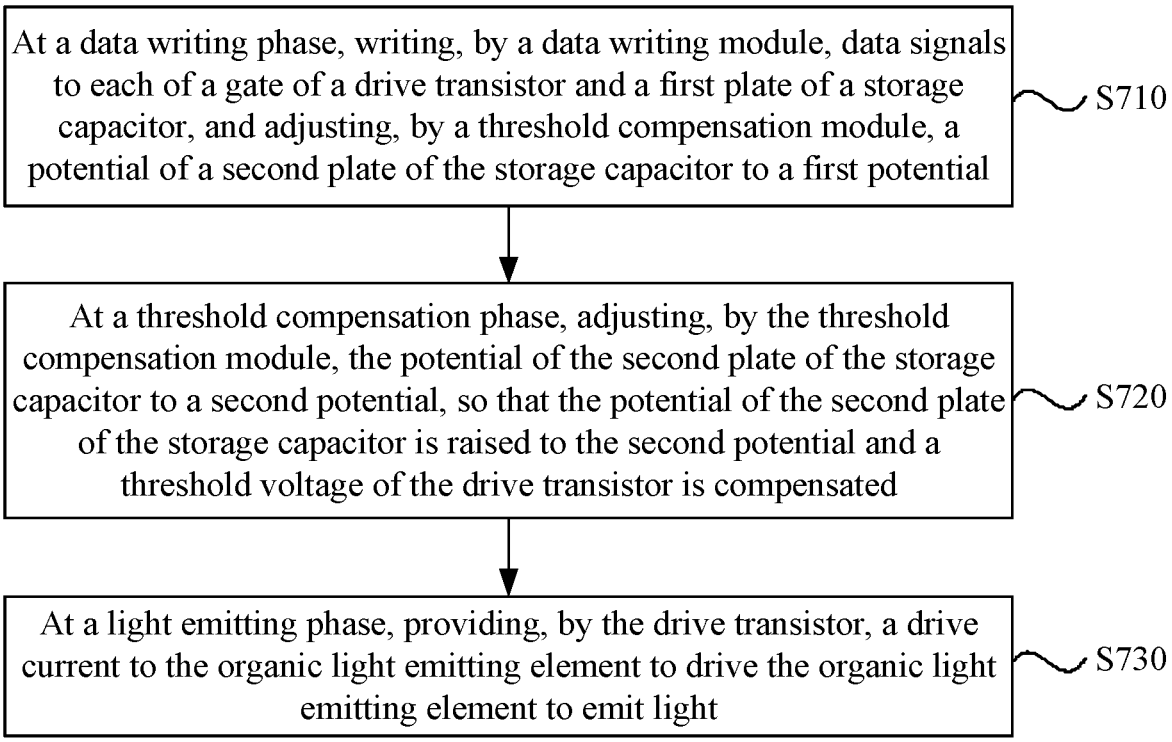
FIG. 8 is a flowchart of a drive method of a pixel circuit according to an embodiment of the present disclosure.

The embodiments of the present disclosure further provide a drive method of a pixel circuit. The drive method is applied to the pixel circuit provided by the embodiments of the present disclosure. FIG. 8 is a flowchart of a drive method of a pixel circuit according to an embodiment of the present disclosure. As shown in FIG. 8, the drive method includes the steps described below.

In S710, at a data writing phase, a data writing module writes data signals to each of a gate of a drive transistor and a first plate of a storage capacitor, and a threshold compensation module adjusts a potential of a second plate of the storage capacitor to a first potential.

In S720, at a threshold compensation phase, the threshold compensation module adjusts the potential of the second plate of the storage capacitor to a second potential, so that the potential of the second plate of the storage capacitor is raised to the second potential and a threshold voltage of the drive transistor is compensated, where the second potential is greater than the first potential.

In S730, at a light emitting phase, the drive transistor provides a drive current to the organic light emitting element to drive the organic light emitting element to emit light.

Exemplarily, the drive method of a pixel circuit provided by this embodiment of the present disclosure is applied to the pixel drive circuit shown in FIG. 1. As shown in FIG. 1, at the data writing phase, the data writing module 12 and the threshold compensation module 11 are turned on. The data signal Vdata of the data signal terminal Data is written into the gate of the drive transistor T and the first plate C1 of the storage capacitor Cst through the turned-on data writing module 12, and the first reset signal Vref1 of the first reset signal terminal Ref adjusts the potential of the second plate C2 of the storage capacitor Cst to the first potential V1 through the turned-on threshold compensation module 11, so that a potential difference is generated between the first plate C1 and the second plate C2 of the storage transistor T. At the threshold compensation phase, the data writing module 12 is turned off. The first reset signal Vref1 of the first reset signal terminal Ref is reversed. The threshold compensation module 11 remains turned on. In this case, the reversed first reset signal Vref1 is written into the second plate C2 of the storage capacitor Cst through the turned-on threshold compensation module 11, so that the potential of the second plate C2 of the storage capacitor Cst is adjusted to the second potential V2.

The potential difference between the second potential V2 and the first potential ΔV is (V2−V1). The potential of the first plate C1 of the storage capacitor Cst is increased by ΔV due to the coupling effect of the storage capacitor Cst. In this case, the potential of the first plate C1 of the storage capacitor Cst is adjusted to the third potential V3=Vdata+ΔV. When ΔV includes the threshold voltage of the drive transistor T, the gate potential of the drive transistor T electrically connected to the first plate C1 of the storage capacitor Cst is also adjusted to V3, thereby implementing the threshold compensation on the drive transistor T, so that at the light emitting phase, the drive current provided by the drive transistor T to the organic light emitting element 13 can drive the organic light emitting element 13 to emit light stably.

In the embodiments of the present disclosure, with the coupling effect of the storage capacitor, by generating the potential difference between the first plate and the second plate of the storage capacitor at the data writing phase, and by changing the potential of the second plate of the storage capacitor at the threshold compensation phase, the potential of the first plate of the storage capacitor changes with the potential of the second plate of the storage capacitor, thereby implementing the threshold compensation, and improving the display luminescence effect of the pixel.

Optionally, the threshold compensation module of the pixel circuit may include a first transistor, and the data writing module may include a second transistor. Exemplarily, as shown in FIG. 3, the threshold compensation module 11 of the pixel circuit includes a first transistor M1, and the data writing module 12 includes a second transistor M2. The first electrode of the first transistor M1 receives the first reset signal Vref of the first reset signal terminal Ref, the second electrode of the first transistor M1 is electrically connected to the second plate C2 of the storage capacitor Cst, and the gate of the first transistor M1 is electrically connected to the anode of the organic light emitting element 13. The first electrode of the second transistor M2 receives the data signal Vdata of the data signal terminal Data, the second electrode of the second transistor M2 is electrically connected to the gate of the drive transistor T and the first plate of the storage capacitor Cst, and the gate of the second transistor M2 receives the first scanning signal S1 of the first scanning signal terminal Scant. The first electrode of the drive transistor T receives the power signal Vdd of the power signal terminal PVDD, and the second electrode of the drive transistor T is electrically connected to the anode of the organic light emitting element 13. The cathode of the organic light emitting element 13 receives the logic low-level signal Vee of the logic low-level signal terminal PVEE.

Figure 9:
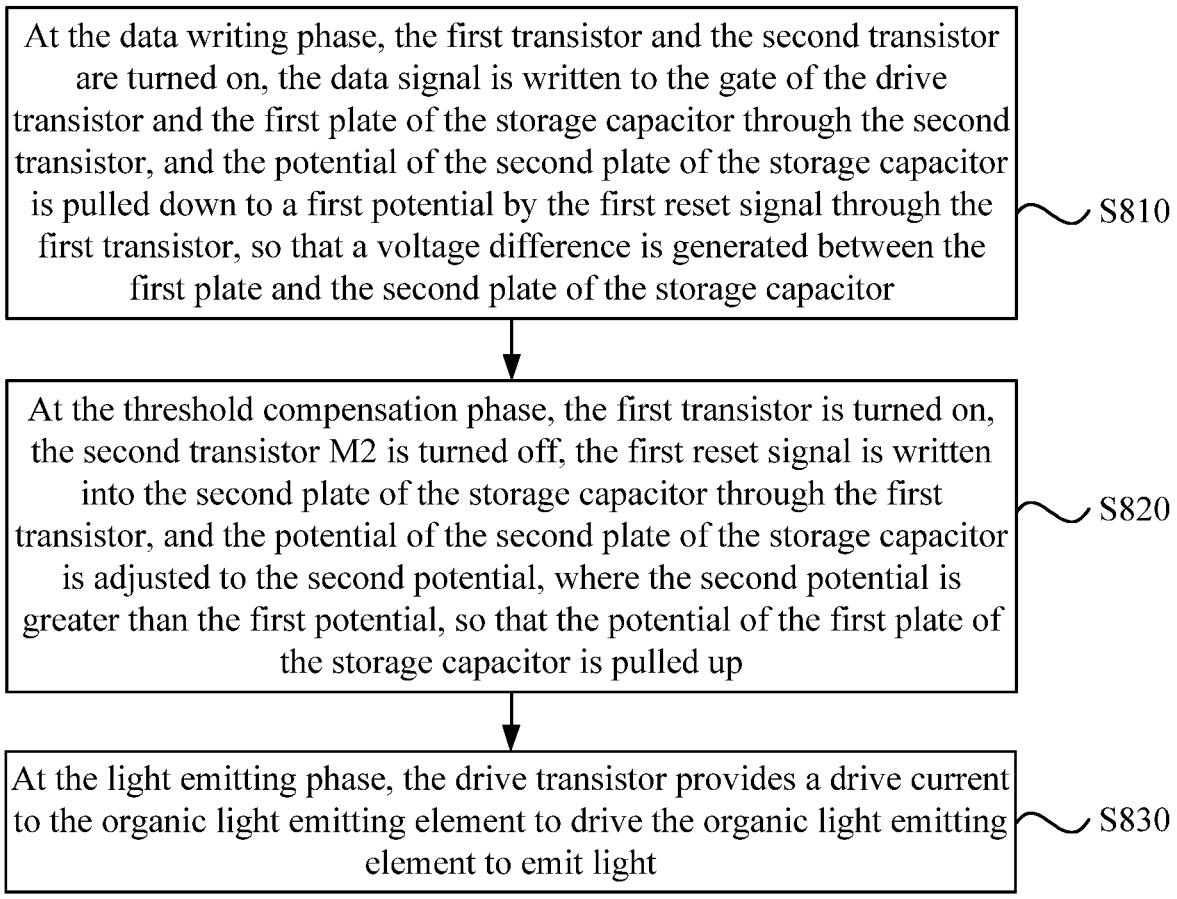
FIG. 9 is a flowchart of another drive method of a pixel circuit according to an embodiment of the present disclosure.

FIG. 9 is a flowchart of another drive method of a pixel circuit according to an embodiment of the present disclosure. As shown in FIG. 9, the drive method includes steps described below.

In S810, at the data writing phase, the first transistor and the second transistor are turned on, the data signal is written into the gate of the drive transistor and the first plate of the storage capacitor through the second transistor, and the first reset signal pulls down the potential of the second plate of the storage capacitor to a first potential through the first transistor, so that a voltage difference is generated between the first plate and the second plate of the storage capacitor.

In S820, at the threshold compensation phase, the first transistor is turned on, the second transistor M2 is turned off, the first reset signal is written into the second plate of the storage capacitor through the first transistor, and the potential of the second plate of the storage capacitor is adjusted to the second potential, where the second potential is greater than the first potential, so that the potential of the first plate of the storage capacitor is pulled up.

In S830, at the light emitting phase, the drive transistor provides a drive current to the organic light emitting element to drive the organic light emitting element to emit light.

Exemplarily, the drive method of a pixel circuit provided by this embodiment of the present disclosure adopts the drive timing shown in FIG. 4 to drive the pixel drive circuit shown in FIG. 3. With reference to FIGS. 3 and 4, at the data writing phase t1, the first transistor M1 and the second transistor M2 are turned on. The data signal Vdata of the data terminal Data is written into the gate of the drive transistor T and the first plate C1 of the storage capacitor Cst through the turned-on second transistor M2. Meanwhile the first reset signal Vref1 at the logical low-level state of the first reset signal terminal Ref adjusts the potential of the second plate C2 of the storage capacitor Cst through the turned-on first transistor M1, so that the potential of the second plate C2 of the storage capacitor Cst is adjusted to the first potential V1=Ve+Ved−Vth2. In this case, the potential difference (Vdata−V1) is generated between the first plate C1 and the second plate C2 of the storage capacitor Cst. At the threshold compensation phase t2, the first reset signal of the first reset signal terminal Ref is reversed. The first transistor M1 continues to be turned on. The second transistor M2 is turned off. The first reset signal Vref1 at the logical high-level state of the first reset signal terminal Ref is written into the second plate C2 of the storage capacitor Cst through the turned-on first transistor M1, so that the potential of the second plate C2 of the storage capacitor Cst is adjusted to the second potential V2. In this case, the potential of the second plate C2 of the storage capacitor Cst is increased by ΔV=V2−Vee−Voled+Vth2. Due to the coupling effect of the storage capacitor Cst, the potential of the first plate C1 of the storage capacitor Cst is increased by ΔV. In this case, the potential of the first plate C1 of the storage capacitor Cst is adjusted to V3=Vdata+V2−Vee−Voled+Vth2. When the influence of the difference between the threshold voltage Vth2 of the first transistor M1 and the threshold voltage Vth1 of the drive transistor T on the drive current is ignored, it is considered that the drive current provided by the drive transistor T to the organic light emitting element 13 is independent of the threshold voltage Vth1 of the drive transistor T, thereby implementing the threshold compensation and improving the display effect of the pixel.

The embodiments of the present disclosure further provide a display panel. The display panel includes the pixel circuit provided in the embodiments of the present disclosure. Therefore, the display panel has the beneficial effects of the pixel circuit provided in the embodiments of the present disclosure, and the same portions can be understood with reference to the above description, and are not described in detail below.

Figure 10:
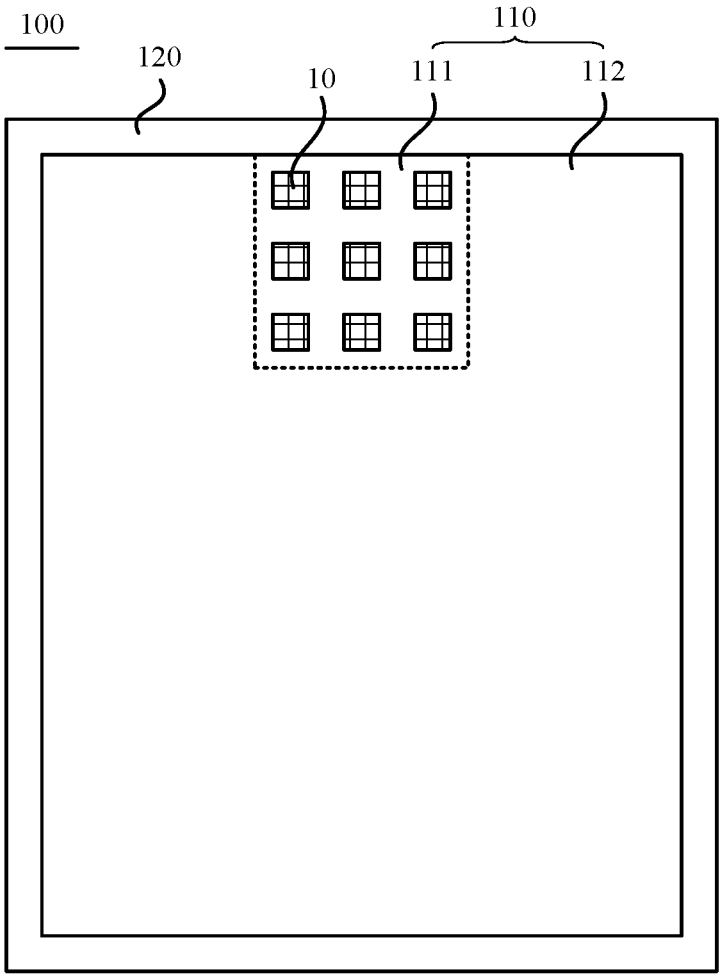
FIG. 10 is a structural diagram of a display panel according to an embodiment of the present disclosure.

Exemplarily, FIG. 10 is a structural diagram of a display panel according to an embodiment of the present disclosure. As shown in FIG. 10, the display panel 100 includes a display region 110 and a non-display region 120 surrounding the display region 110. The display region 110 at least includes a first display region 111. The first display region 111 includes multiple first pixel circuits 10 arranged in an array, and the first pixel circuit 10 is the pixel circuit provided in the embodiments of the present disclosure. When the organic light emitting element in the first pixel circuit 10 emits light, the first display region 111 can display corresponding pictures.

The display region 110 of the display panel 100 further includes a second display region 112. The pixel circuit of the second display region 112 may also include the pixel circuit provided in the embodiments of the present disclosure. In this case, the pixel circuits of the display region of the display panel 100 are all pixel circuit provided in the embodiments of the present disclosure. Compared with the pixel circuit having a threshold compensation structure in the related art, the pixel circuit provided in the embodiments of the present disclosure has a simple structure and can have a smaller design size. When all pixel circuits of the display panel 100 use the pixel circuit provided in the embodiments of the present disclosure, the resolution of the display panel 100 can be improved.

Alternatively, the pixel circuit of the second display region 112 of the display panel 100 may also be any pixel circuit in the related art, for example, a pixel circuit with 7T1C design (seven transistors, one capacitor and one organic light emitting element). When the pixel density of the first display region 111 is the same as that of the second display region 112, the area occupied by the pixel circuit of the first display region 111 is smaller, which can increase the area of the high-transmittance region in the first display region 111 and improve the intensity of light transmitted through the first display region 111.

Figure 11:
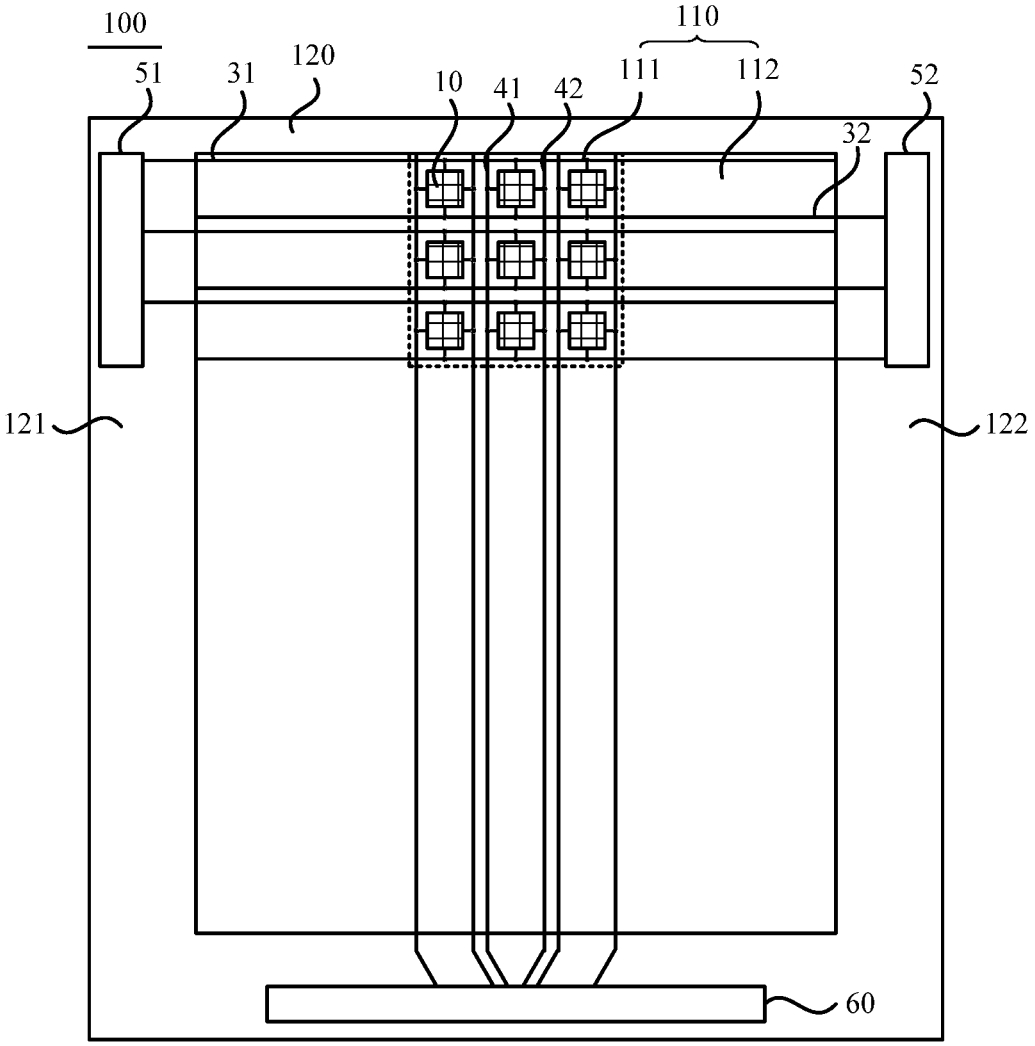
FIG. 11 is a structural diagram of another display panel according to an embodiment of the present disclosure.

Optionally, FIG. 11 is a structural diagram of another display panel according to an embodiment of the present disclosure. As shown in FIG. 11, the display region of the display panel 100 further includes multiple first scanning signal lines 31, multiple first reset signal lines 32, multiple data signal lines 41 and multiple power signal lines 42. The first pixel circuits 10 in the same row share one first scanning signal line 31 and one first reset signal line 32. The first pixel circuits 10 in the same column share one data signal line 41 and one power signal line 42.

The non-display region 120 of the display panel 100 includes multiple cascaded first scan drive circuits 51, multiple cascaded first reset drive circuits 52 and an integrated drive circuit 60. The output terminal of the first scan drive circuit 51 is electrically connected to the first scanning signal line 31, and is configured to provide a first scanning signal S1 and transmit the first scanning signal S1 to the first pixel circuit 10 through the first scanning signal line 31. The output terminal of the first reset drive circuit 52 is electrically connected to the first reset signal line 32, and is configured to provide a first reset signal 32 and transmit the first reset signal to the first pixel circuit 10 through the first reset signal line Vref1. The data signal output terminal of the integrated drive circuit 60 is electrically connected to the data signal line 41, and is configured to provide a data signal Vdata to the data signal line 41 and transmit the data signal to the first pixel circuit 10 through the data signal line 41. The power signal output terminal of the integrated drive circuit 60 is electrically connected to the power signal line 42, and is configured to provide a power signal Vdd to the power signal line 42 and transmit the power signal to the first pixel circuit 10 through the power signal line 42.

Exemplarily, the first pixel circuit 10 is used as an example of the pixel circuit shown in FIG. 3. With reference to FIGS. 11 and 3, the first reset signal terminals Ref of the first pixel circuits 10 in the same row are electrically connected to the same first reset signal line 32, and the first scanning signal terminals Scant of the first pixel circuits 10 in the same row are electrically connected to the same first scanning signal line 31; the data signal terminals Data of the first pixel circuits 10 in the same column are electrically connected to the same data signal line 41, and the power signal terminals PVDD of the first pixel circuits 10 in the same column are electrically connected to the same power signal line 42. When multiple cascaded first scan drive circuits 51 are electrically connected in one-to-one correspondence to multiple first scanning signal lines 31, the first scanning signals S1 provided by the multiple cascaded first scan drive circuits 51 can control conduction and disconnection of the second transistor M2 in each first pixel circuit 10 separately through each of the multiple first scanning signal lines 31, so that when the second transistor M2 in the first pixel circuit 10 is turned on, the data signal Vdata provided by the integrated drive circuit 60 can be written into the gate of the drive transistor T of the first pixel circuit 10 and the first plate C1 of the storage capacitor Cst through the data signal line 41 and the turned-on first transistor M1 successively. When the multiple cascaded first reset drive circuits 52 are electrically connected in one-to-one correspondence to multiple first reset signal lines 32, the first reset signals Vref1 provided by the multiple cascaded first reset drive circuits 52 can adjust the potential of the second plate C2 of the storage capacitor Cst in each first pixel circuit 10 separately through each of the multiple first reset signal lines 32. At the same time, the integrated drive circuit 60 can further provide power signals to the power signal terminals PVDD of each column of the first pixel circuits 10 through each power signal line 42, so that each first pixel circuit 10 can work normally.

Through the above configuration, each first pixel circuit 10 in the first display region 111 can be driven row by row, so that threshold compensation can be performed on the drive transistor T of the first pixel circuit 10 of the first display region 111, thereby improving display uniformity of the first display region 111 and improving display effect of the display panel 100.

It is to be noted that the first reset signal of the first reset signal terminal of the pixel circuit (i.e., the first pixel circuit) is different from the reset signal written into the pixel circuit in the related art (e.g., pixel circuit of 7T1C). Since the first reset signal of the first reset signal terminal in the first pixel circuit has a rising edge during the transition from the data writing phase to the threshold compensation phase, dependent first reset drive circuits are required in the embodiments of the present disclosure, so that the first reset signals Vref1 provided to the first reset signal terminals of each row of first pixel circuits at the data writing phase are different from the first reset signals Vref1 provided to the first reset signal terminals of each row of first pixel circuits at the threshold compensation phase. On the premise that the drive timing of the pixel circuit provided in the embodiments of the present disclosure can be implemented, the specific drive manner and structure of the first reset drive circuit may be the same as a drive manner and structure of a scan drive circuit in the related art, which is not specifically limited in the embodiments of the present disclosure.

Optionally, with continued reference to FIG. 11, the non-display region 120 of the display panel 100 at least includes a first non-display region 121 and a second non-display region 122. The first non-display region 121 and the second non-display region 122 are located on opposite sides of the display region 110. The first scan drive circuit 51 may be disposed in the first non-display region 121, and the first reset drive circuit 52 may be disposed in the second non-display region 122.

By disposing the first scan drive circuit 51 and the first reset drive circuit 52 on the opposite sides of the display region 110, borders on the opposite sides of the display region 110 can be symmetrical. At the same time, by disposing the first scan drive circuit 51 in the first non-display region 121 and disposing the first reset drive circuit 52 in the second non-display region 122, lines of the first scan drive circuit 51 will not interfere with lines of the first reset drive circuit 52, which is conducive to the trace design of the first scan drive circuit 51 and the first reset drive circuit 52, thereby improving the display effect of the display panel 100.

It is to be noted that FIG. 11 is only an exemplary drawing of the embodiment of the present disclosure, and the first scan drive circuit 51 and the first reset drive circuit 52 in FIG. 11 are separately disposed on opposite sides of the display region 110 in the display panel 100 to achieve the above objective. Without considering the foregoing objective, the first scan drive circuit 51 and the first reset drive circuit 52 may be disposed on the same side of the display region 110, which is not specifically limited in the embodiments of the present disclosure.

Figure 12:
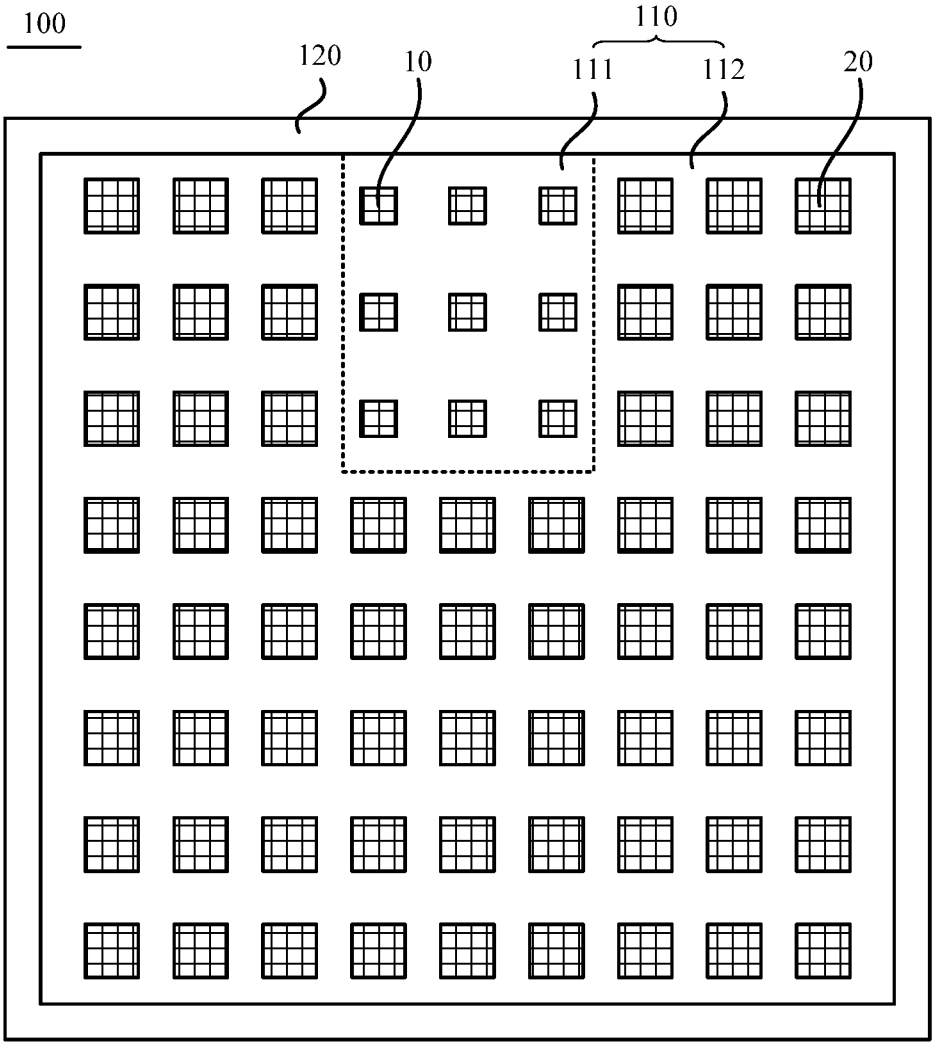
FIG. 12 is a structural diagram of another display panel according to an embodiment of the present disclosure.

Optionally, FIG. 12 is a structural diagram of another display panel according to an embodiment of the present disclosure. As shown in FIG. 12, the display region 110 of the display panel 100 includes a first display region 111 and a second display region 112. The pixel circuit in the first display region 111 may be a first pixel circuit 10, and the pixel circuit disposed in the second display region 112 may be a second pixel circuit 20, that is, the first display region 111 is provided with first pixel circuits 10 arranged in an array, and the second display region 112 is provided with second pixel circuits 20 arranged in an array. The coverage area of the second pixel circuit 20 is greater than the coverage area of the first pixel circuit 10.

When the number of first pixel circuits 10 per unit area in the first display region 111 is the same as the number of second pixel circuits 20 per unit area in the second display region 112, the first display region 111 may be reused as a sensor setting region. In such a way, since the first pixel circuit 10 disposed in the first display region 111 is the pixel circuit provided in the embodiments of the present disclosure, the first pixel circuit 10 disposed in the first display region 111 has a simpler structure and a smaller coverage area; the second pixel circuit 20 disposed in the second display region 112 may be any pixel circuit in the related art, and the area covered by the second pixel circuit 20 is large. In this case, compared with the case where the pixel circuits in both the first display region 111 and the second display region 112 are the second pixel circuits, the area of the high-transmittance region in the first display region 111 can be increased. When the first display region 111 is used as the sensor setting region, the area of medium-transmittance and high-transmittance region in the sensor setting region can be increased while the display panel 100 can have a high screen-to-body ratio and display uniformity, so that the intensity of light transmitted through the sensor setting region can be increased. Exemplarily, when a camera is set in the sensor setting region, more external light transmitted through the first display region 111 can be acquired by the camera, thereby improving imaging quality of the camera.

Figure 13:
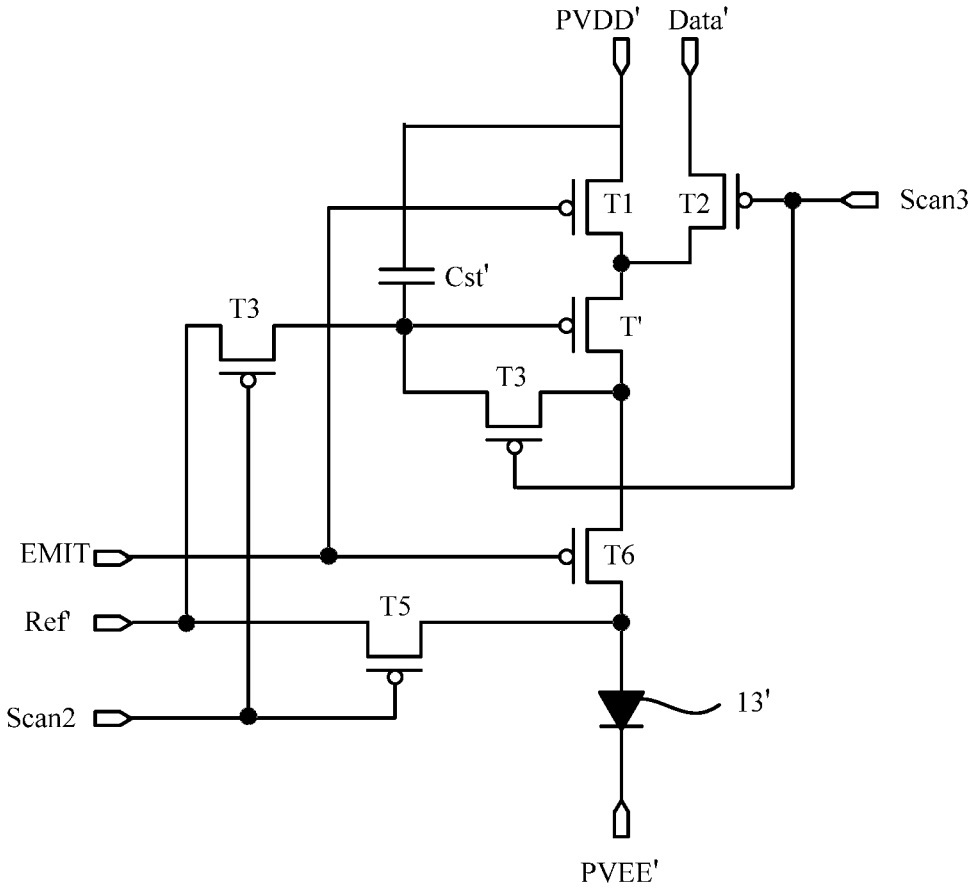
FIG. 13 is a structural diagram of a second pixel circuit according to an embodiment of the present disclosure.
Figure 14:
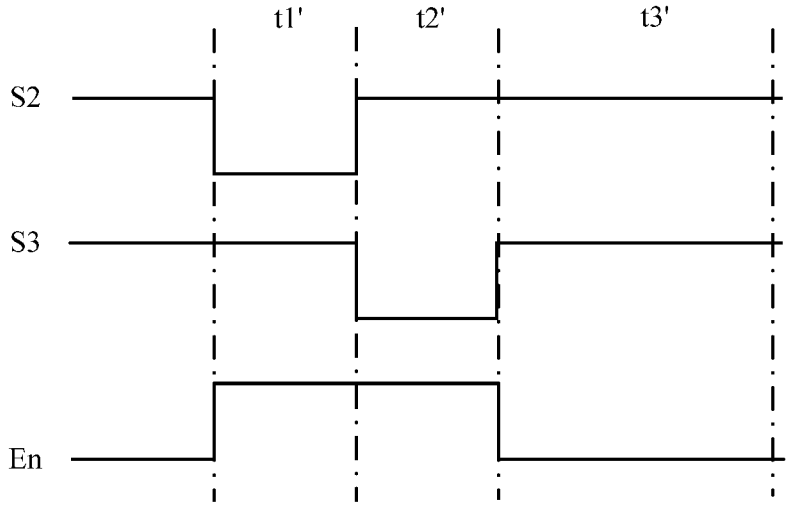
FIG. 14 is a drive timing graph of a second pixel circuit according to an embodiment of the present disclosure.

Exemplarily, FIG. 13 is a structural diagram of a second pixel circuit according to an embodiment of the present disclosure, and FIG. 14 is a drive timing graph of a second pixel circuit according to an embodiment of the present disclosure. With reference to FIGS. 13 and 14, the second pixel circuit includes a drive transistor T', a storage capacitor Cst', an organic light emitting element 13', light emitting control transistors T1 and T6, initialization transistors T3 and T5, a data write transistor T3, and a threshold compensation transistor T4. The second pixel circuit further includes a power signal terminal PVDD', a logic low-level signal terminal PVEE', a second reset signal terminal Ref, a light emitting control signal terminal Emit, a second scanning signal terminal Scan2 and a third scanning signal terminal Scan3. The second scanning signal S2 of the second scanning signal terminal Scan2 can control the initialization transistors T3 and T5 to turn on at the initialization phase t1', so that the second reset signal Vref2 of the second reset signal terminal Ref initializes the gate of the drive transistor T', the storage capacitor Cst' and the anode of the organic light emitting element 13' through the turned-on initialization transistors T3 and T5. The third scanning signal S3 of the third scanning signal terminal Scan3 can control the data write transistor T3 and the threshold compensation transistor T4 to turn on at the threshold compensation phase t2', so that the data signal Vdata of the data signal terminal Data' is sequentially written into the gate of the drive transistor T' and the storage capacitor Cst' through the turned-on data write transistor T3 and the threshold compensation transistor T4. The light emitting control signal En of the light emitting control signal Emit controls the light emitting control transistors T1 and T6 to turn on at the light emitting control phase, so that the drive transistor T can provide a drive current to the organic light emitting element 13' and to drive the organic light emitting element 13' to emit light, and the drive current provided by the drive transistor T to the organic light emitting element 13' is independent of the threshold voltage of the drive transistor T'. Therefore, both the first pixel circuit and the second pixel circuit can realize the threshold compensation function, thereby improving the display uniformity of the display panel and the display effect of the display panel.

Since the second reset signal Vref2 of the second reset signal terminal Ref in the second pixel circuit is a logic low-level signal, that is, this signal can implement the initialization of the gate of the drive transistor T', the storage capacitor Cst' and the organic light emitting element 13', the second reset signal Vref2 of the second reset signal terminal Ref in the second pixel circuit 20 is different from the first reset signal Vref1 of the first reset signal terminal Ref in the first pixel circuit 10.

Figure 15:
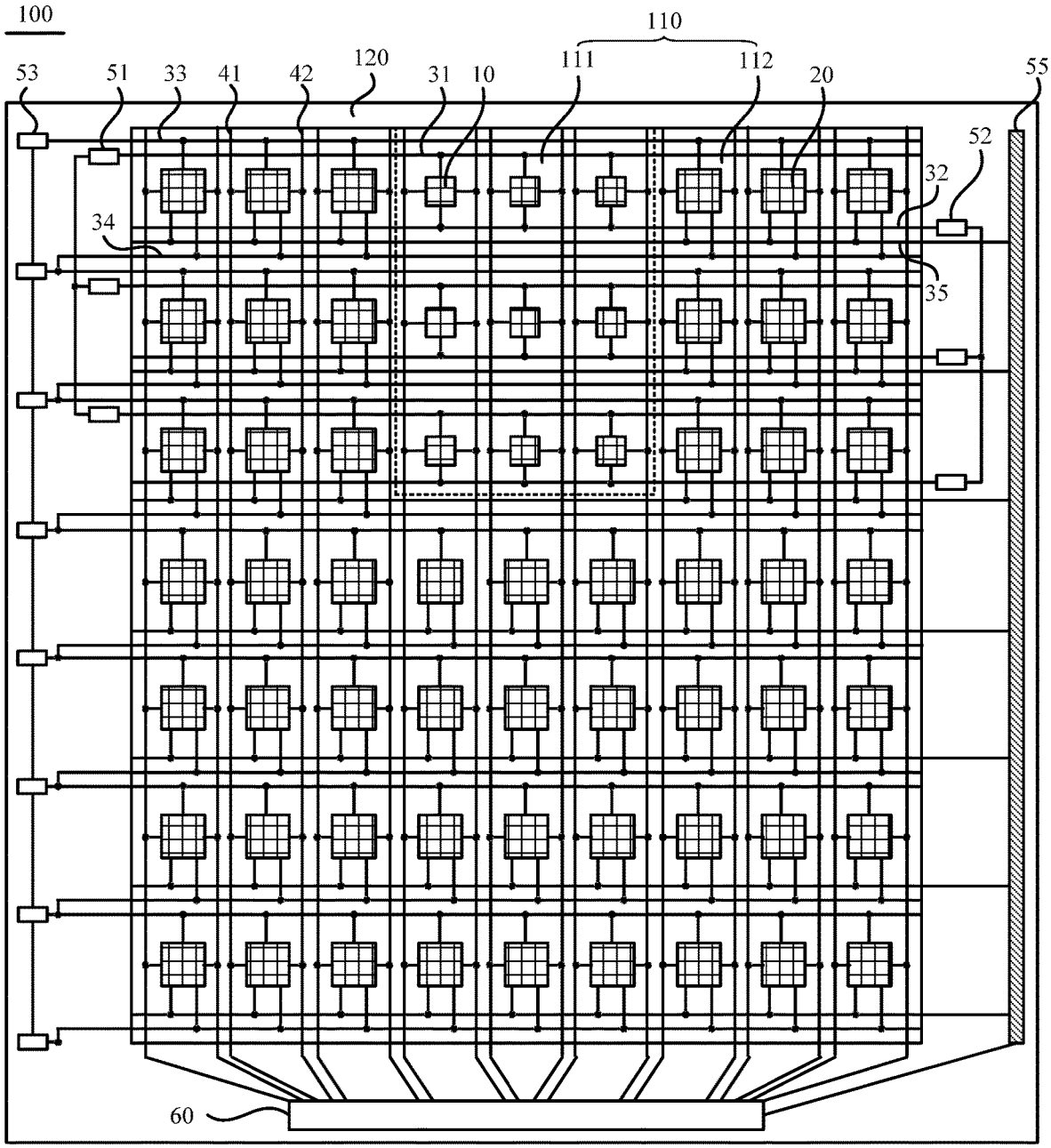
FIG. 15 is a structural diagram of another display panel according to an embodiment of the present disclosure.

Optionally, FIG. 15 is a structural diagram of another display panel according to an embodiment of the present disclosure. As shown in FIG. 15, the second display region 112 of the display panel 100 further includes multiple second scanning signal lines 33, multiple third scanning signal lines 34, multiple second reset signal lines 35, multiple data signal lines 41, and multiple power signal lines 42. The second pixel circuits 20 in the same row share one second scanning signal line 33, one third scanning signal line 34 and one reset signal line 35. The first pixel circuits 10 and the second pixel circuits 20 in the same column share one data signal line 41 and one power signal line 42.

The non-display region 120 of the display panel 100 further includes multiple cascaded second scan drive circuits 53 and a reset signal bus 55. The output terminal of the second scan drive circuit 53 is electrically connected to the second scanning signal line 33 and/or the third scanning signal line 34. The second scan drive circuit 53 electrically connected to the second scanning signal line 33 is configured to provide a second scanning signal S2 and transmit the second scanning signal to the second pixel circuit 20 through the second scanning signal line 33. The second scan drive circuit 53 electrically connected to the third scanning signal line 34 is configured to provide a third scanning signal S3 and transmit the third scanning signal to the second pixel circuit 20 through the third scanning signal line 33. At the same time, third scanning signals S3 of the previous row of second pixel circuits 20 may be reused as second scanning signals S2 of the next row of second pixel circuits 20, that is, when the previous row of second pixel circuits 20 are at the threshold compensation phase, the next row of second pixel circuits 20 are at the initialization phase.

In addition, the reset signal output terminal of the integrated drive circuit 60 disposed in the non-display region 120 of the display panel 100 is electrically connected to the second reset signal line 35 through the reset signal bus 55. The integrated drive circuit 60 is further configured to provide a second reset signal Vref2, and transmit the second reset signal to the second pixel circuit 20 through the reset signal bus 55 and the second reset signal line 35 sequentially. The integrated drive circuit 60 is further configured to transmit a data signal to the second pixel circuit 20 through the data signal line 41, and transmit a power signal to the second pixel circuit 20 through the power signal line 42.

Specifically, the second pixel circuit 20 disposed in the second display region 112 has a large size, the second pixel circuit 20 also has a threshold compensation function, and the second pixel circuit 20 may at least include a second scanning signal terminal, a third scanning signal terminal, a second reset signal terminal, a data signal terminal, and a power signal terminal. In this case, the second scan drive circuit 53 provides the second scanning signals S2 to the second scanning signal terminals of the second pixel circuits 20 in the same row through the second scanning signal line 33. The second scan drive circuit 53 further provides the third scanning signals S3 to the third scanning signal terminals of the second pixel circuits 20 in the same row through the third scanning signal line 34. The integrated drive circuit 60 provides the second reset signals Vref2 to the second reset signal terminals of the second pixel circuits 20 in the same row through the reset signal bus 55 and the second reset signal line 35 sequentially. At the same time, the integrated drive circuit 60 can also provide the data signals Vdata to the data signal terminals of the second pixel circuits 20 in the same column through the data signal line 41, and provide the power signals Vdd to the power signal terminals of the second pixel circuits 20 in the same column through the power signal line 42. In such a way, various pixel circuits in the display panel 100 can be derived row by row, so that the display panel can display corresponding pictures.

It is to be noted that FIG. 15 is only an exemplary drawing of the embodiments of the present disclosure. In FIG. 15, the first scan drive circuit 51 and the second scan drive circuit 53 are located on the same side of the display region 110. In the embodiments of the present disclosure, the first scan drive circuit 51 and the second scan drive circuit 53 may also be located on different sides of the display region 110, or the first scan drive circuit 51 and the second scan drive circuit 53 may be integrated into a scan drive circuit, which is not specifically limited in the embodiments of the present disclosure. In addition, the reset signal bus 55 and the first reset drive circuit 52 are disposed on the same side. In the embodiments of the present disclosure, the reset signal bus 55 and the first reset drive circuit 52 may be disposed on different sides, or the reset signal bus 55 may be disposed on opposite sides of the display region 110, which is not specifically limited in the embodiments of the present disclosure.

In addition, since the coverage area of the second pixel circuit is larger than the coverage area of the first pixel circuit, the load of the second pixel circuit may be more than the load of the first pixel circuit. Therefore, the width of the data signal line, the power signal line, the first reset signal line and the first scanning signal line which are used for connecting the first pixel circuits in the first display region is less than the width of the data signal line, the power signal line, the second reset signal line and the second scanning signal line in the second display region. In such a way, on one hand, the load of the first display region can be increased during signal transmission, so that the signals transmitted to the first display region and the second display region are consistent, thereby improving the display uniformity of the display panel; on the other hand, the width of the signal line in the first display region is narrowed, which can further enlarge the area of the high-transmittance region in the first display region, so that when the first display region is reused as the sensor setting region, the intensity of the light collected by the sensor can be improved, thereby further improving the imaging quality of the image sensor such as a camera.

Figure 16:
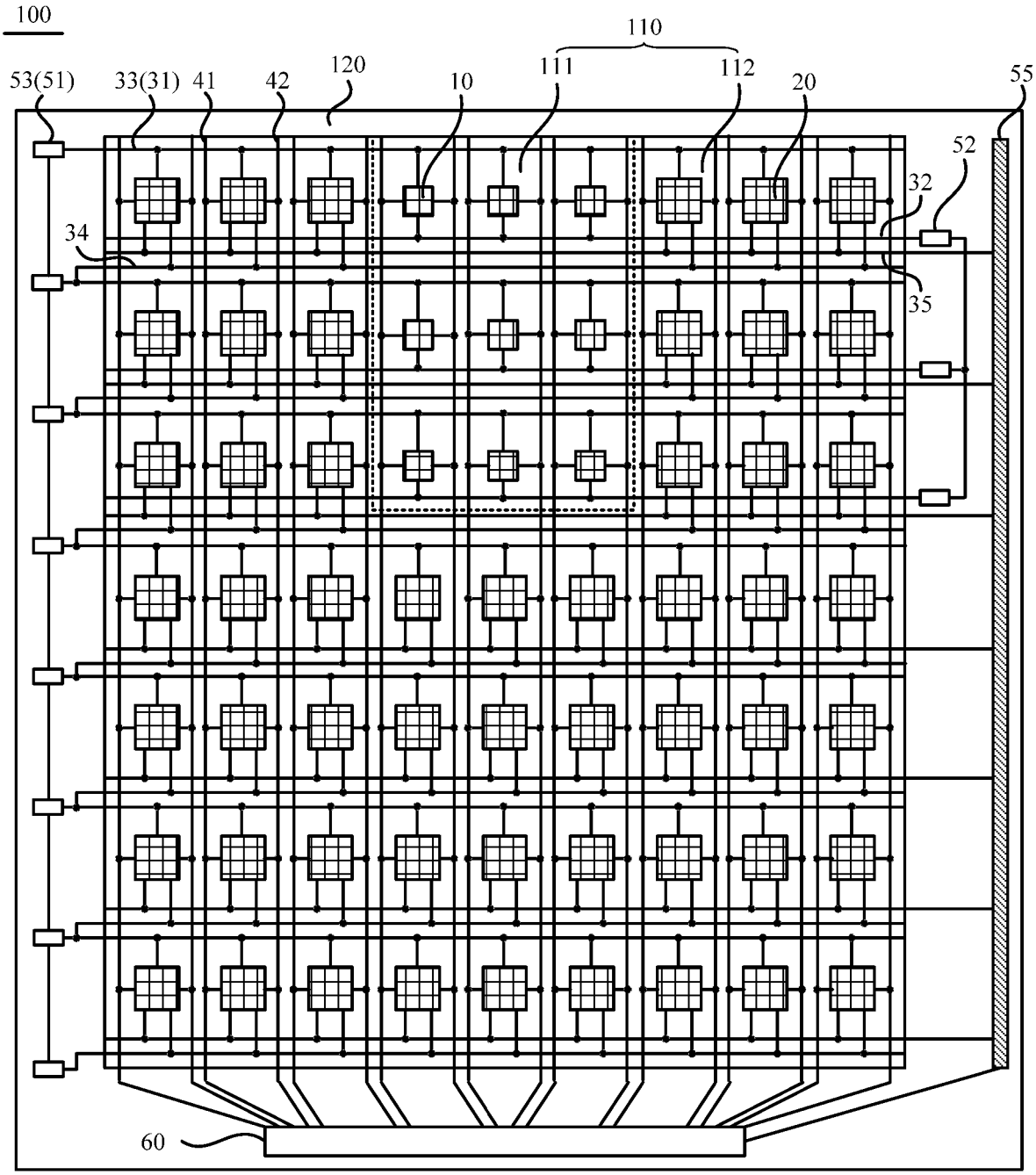
FIG. 16 is a structural diagram of another display panel according to an embodiment of the present disclosure.

Optionally, FIG. 16 is a structural diagram of another display panel according to an embodiment of the present disclosure. As shown in FIG. 16, the second scan drive circuit 53 may be reused as the first scan drive circuit 51, and the second scanning signal line 33 or the third scanning signal line 34 is reused as the first scanning signal line 31.

Exemplarily, the first pixel circuit shown in FIG. 3 and the drive timing shown in FIG. 4 are used as examples, and the second pixel circuit shown in FIG. 13 and the drive timing shown in FIG. 14 are used as examples. With reference to FIGS. 3, 4, 13, 14 and 16, the second scan drive circuit 53 may provide the second scanning signal S2 to the second scanning signal terminal Scan2 of the second pixel circuit 20 through the second scanning signal line 33, and the second scan drive circuit 53 may further provide the third scanning signal S3 to the third scanning signal terminal Scan3 of the second pixel circuit 20 through the third scanning signal line 34. When the second scan drive circuit 53 is reused as the first scan drive circuit 51 and the second scanning signal line 33 is reused as the first scanning signal line 31, the second scan drive circuit 53 can provide first scanning signals S1 to the first scanning signal terminals Scant of the first pixel circuits 10 in the same row and provide second scanning signals S2 to the second scanning signal terminals Scan2 of the second pixel circuits 20 through the second scanning signal line 33, so that the first pixel circuit 10 enters the data writing phase t1 and the second pixel circuit 20 enters the initialization phase t1'. In such a way, the scan drive circuits disposed in the non-display region 110 can be reduced, and the size of the non-display region 110 can be reduced, facilitating a narrow border of the display panel 100.

Alternatively, when the third scan drive circuit is reused as the first scan drive circuit, the second scan drive circuit provides first scanning signals S1 to the first scanning signal terminals of the first pixel circuits in the same row through the third scanning signal line and provides third scanning signals S3 to the third scanning signal terminals of the second pixel circuits, so that the first pixel circuit enters the data writing phase t1 and the second pixel circuit enters the threshold compensation phase t2'. In such a way, the first pixel circuits and the second pixel circuits can also be driven row by row, the scan drive circuits disposed in the non-display region can be reduced, and the size of the non-display region can be reduced, which is conducive to implement the narrow border of the display panel.

Figure 17:
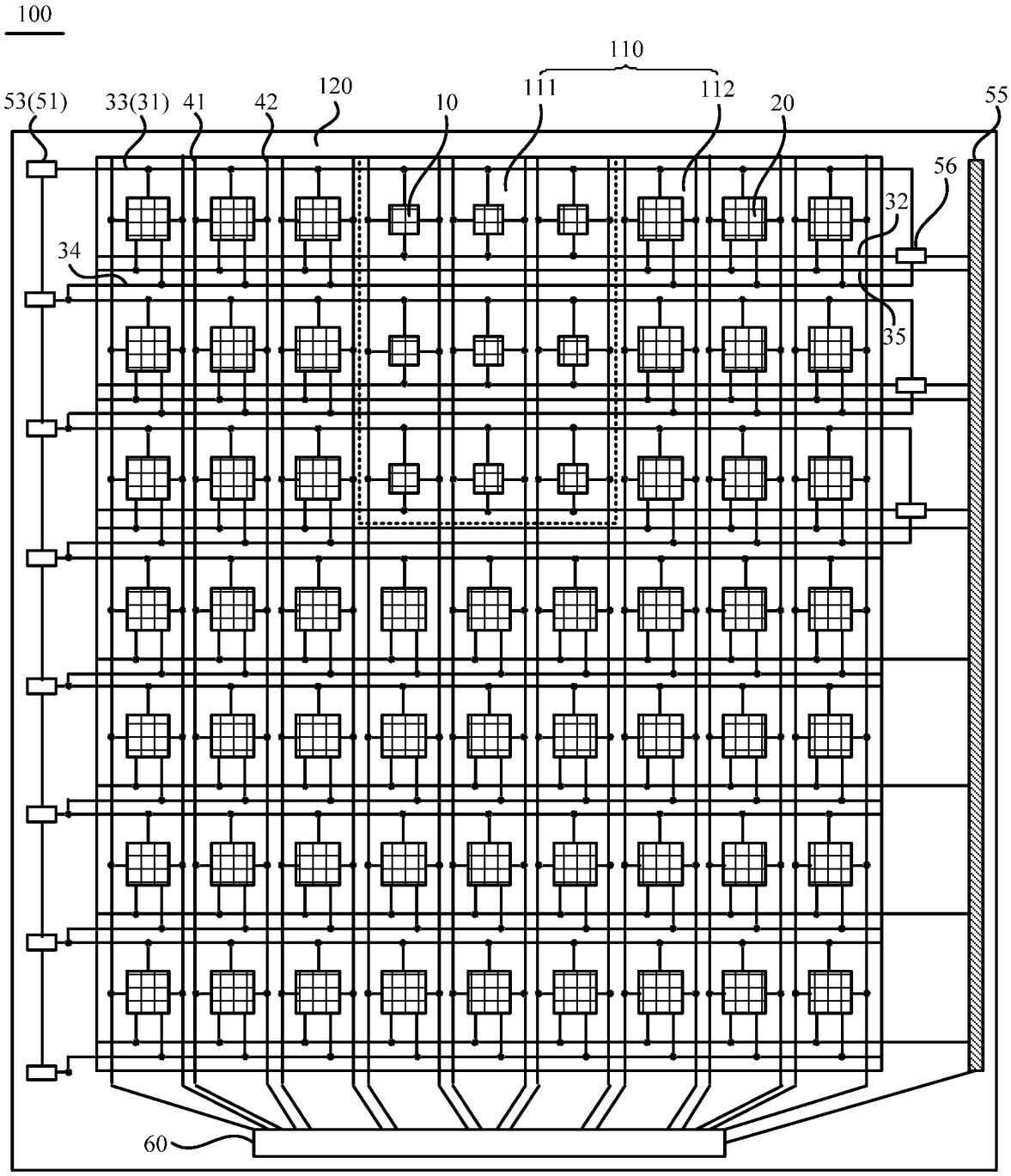
FIG. 17 is a structural diagram of another display panel according to an embodiment of the present disclosure.

Optionally, FIG. 17 is a structural diagram of another display panel according to an embodiment of the present disclosure. As shown in FIG. 17, the non-display region 120 of the display panel further includes a conversion circuit 56.

The conversion circuit 56 is electronically connected between the second scan drive circuit 53 and the first reset signal line 32, and is electrically connected between the reset signal bus 55 and the first reset signal line 32. The conversion circuit 56 is configured to convert the second reset signal Vref2 provided by the reset signal bus 55 into the first reset signal Vref1 at the data writing phase, and convert the second scanning signal S2 or the third scanning signal S3 provided by the second scan drive circuit 53 into the first reset signal Vref1 at the threshold compensation phase. In such a way, the first reset drive circuit for providing the first reset signal Vref to the first pixel circuit does not need to be disposed in the non-display region 120, so that the pixel circuit in the non-display region 120 can be simplified, and the size of the non-display region 120 of the display panel 100 can be reduced, thereby facilitating the narrow border of the display panel.

It is to be noted that as long as the second scanning signal S2, the third scanning signal S3 and the second reset signal Vref2 can be converted into the first reset signal Vref1, the specific structure of the conversion circuit is not limited in the embodiments of the present disclosure.

Figure 18:
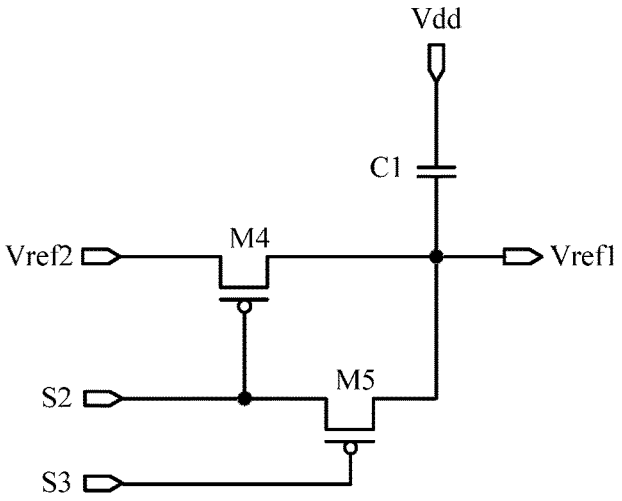
FIG. 18 is a structural diagram of a conversion circuit according to an embodiment of the present disclosure.

Optionally, FIG. 18 is a structural diagram of a conversion circuit according to an embodiment of the present disclosure. With reference to FIGS. 17 and 18, the conversion circuit 56 includes a fourth transistor M4, a fifth transistor M5 and a first capacitor C1. The first electrode of the fourth transistor M4 is electrically connected to the reset signal bus 55, the second electrode of the fourth transistor M4 is electrically connected to the first reset signal line 32, and the gate of the fourth transistor M4 is electrically connected to the output terminal of the second scan drive circuit 53 through the second scanning signal line 33. The first electrode of the fifth transistor M5 is electrically connected to the output terminal of the second scan drive circuit 53 through the second scanning signal line 33, the second electrode of the fifth transistor M5 is electrically connected to the first reset signal line 32, and the gate of the fifth transistor M5 is electrically connected to the output terminal of the second scan drive circuit 53 through the third scanning signal line 34. The first plate of the first capacitor C1 is electrically connected to the first reset signal line 32, and the second plate of the first capacitor C1 is electrically connected to a fixed potential signal line.

Figure 19:
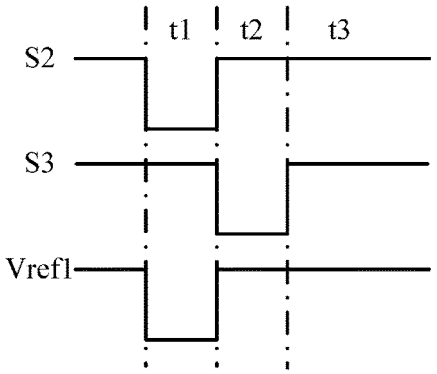
FIG. 19 is a drive timing graph of a conversion circuit according to an embodiment of the present disclosure.

Exemplarily, the first pixel circuit shown in FIG. 3 and the drive timing shown in FIG. 4 are used as examples, and the second pixel circuit shown in FIG. 13 and the drive timing shown in FIG. 14 are used as examples. FIG. 19 is a drive timing graph of a conversion circuit according to an embodiment of the present disclosure. With reference to FIGS. 3, 4, 13, 14, 17, 18 and 19, the fourth transistor M4 and the fifth transistor M5 in the conversion circuit 56 are the P-type transistor. At the initialization phase t1' of the second pixel circuit, the second scanning signal S2 provided by the second scan drive circuit 53 is a logic low-level signal, the fourth transistor M4 is turned on, the fifth transistor M5 is turned off, and the second reset signal Vref2 at the logical low-level state can be transmitted to the first reset signal line 32 through the turned-on fourth transistor M4, so that the first pixel circuit 10 provides the first reset signal Vref1 at the logical low-level state at the data writing phase t1. At the threshold compensation phase t2 of the second pixel circuit 20, the second scanning signal S2 provided by the second scan drive circuit 53 is reversed to a logical high-level signal, the third scanning signal S3 provided by the second scan drive circuit 53 is a logic low-level signal, the fourth transistor M4 is turned off, the fifth transistor M5 is turned on, and the second scanning signal S2 at the logical high-level state is transmitted to the first reset signal line 32 through the turned-on fifth transistor M5, so that the first pixel circuit 10 provides the first reset signal Vref at the logical high-level state at the threshold compensation phase t2. In such a way, when the second pixel circuit 20 is at the initialization phase t1', the first pixel circuit 10 is at the data writing phase t1; when the second pixel circuit 20 is at the threshold compensation phase t2', the first pixel circuit 10 is also at the threshold compensation phase t2; when the second pixel circuit 20 is at the light emitting phase t3', the first pixel circuit 10 can also be in the light emitting phase t3. Therefore, the organic light emitting element 13 in the first pixel circuit 10 and the organic light emitting element 13' in the second pixel circuit 20 can emit light simultaneously, thereby improving the display uniformity of the display panel and the display effect of the display panel.

The fixed potential transmitted by the fixed potential signal line can be the power signal provided by the integrated drive circuit. The integrated drive circuit does not need to additionally set the output terminal for outputting the fixed potential signal needed by the conversion circuit, which simplifies the structure of the integrated drive circuit and reduces the cost of the integrated drive circuit, thereby reducing the cost of the display panel.

It is to be noted that the fifth transistor and the fourth transistor of the conversion circuit may be of the same type as the transistor in the first pixel circuit. Therefore, when the transistor in the first pixel circuit is a P-type transistor, the fifth transistor and the fourth transistor in the conversion circuit are also the P-type transistor; and when the transistor in the first pixel circuit is an N-type transistor, the fifth transistor and the fourth transistor in the conversion circuit are also the N-type transistor, which is not specifically limited in the embodiments of the present disclosure.

In addition, the conversion circuit and the second scan drive circuit may be located on the same side of the display region, or the conversion circuit and the second scan drive circuit may also be located on opposite sides of the display region, that is, the conversion circuit may be electrically connected to the output terminal of the second scan drive circuit through the second scanning signal line and the third scanning signal line. The specific connection manner between the conversion circuit and the second scan drive circuit is not specifically limited in the embodiment of the present disclosure.

The embodiments of the present disclosure further provide a display device. The display device includes the display panel provided in the embodiments of the present disclosure, so the display device also has the beneficial effects of the display panel provided in the embodiments of the present disclosure, and the same portions can be understood with reference to the above description, and are not described in detail below.

Figure 20:
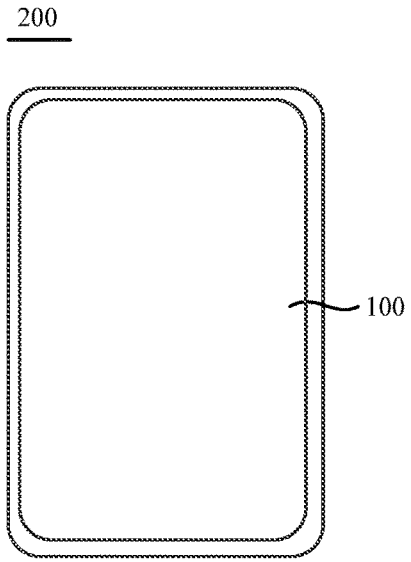
FIG. 20 is a structural diagram of a display device according to an embodiment of the present disclosure.

Exemplarily, FIG. 20 is a structural diagram of a display device according to an embodiment of the present disclosure. As shown in FIG. 20, the display device 200 provided in the embodiments of the present disclosure includes the display panel 100 described in the embodiments of the present disclosure. The display device 200, for example, may be a touch display screen, a mobile phone, a tablet, a laptop or any electronic device having a display function.

It is to be noted that the above are merely preferred embodiments of the present disclosure and the technical principles used therein. It is to be understood by those skilled in the art that the present disclosure is not limited to the specific embodiments described herein. Those skilled in the art can make various apparent modifications, adaptations and substitutions without departing from the scope of the present disclosure. Therefore, while the present disclosure has been described in detail through the preceding embodiments, the present disclosure is not limited to the preceding embodiments and may further include additional equivalent embodiments without departing from the concept of the present disclosure. The scope of the present disclosure is determined by the scope of the appended claims.

What is claimed is:

1. A pixel circuit, comprising: a drive transistor, a storage capacitor, a data writing module, a threshold compensation module, and an organic light emitting element; wherein the data writing module is electrically connected to a gate of the drive transistor and a first plate of the storage capacitor, and is configured to write a data signal to the gate of the drive transistor and the first plate of the storage capacitor at a data writing phase;

the threshold compensation module is electrically connected to a second plate of the storage capacitor, and is configured to adjust a potential of the second plate of the storage capacitor to a first potential at the data writing phase, and adjust the potential of the second plate of the storage capacitor to a second potential at a threshold compensation phase, so that a potential of the first plate of the storage capacitor is adjusted to a third potential and a threshold voltage of the drive transistor is compensated, wherein the second potential is greater than the first potential; and the drive transistor is electrically connected to the organic light emitting element, and is configured to provide a drive current to the organic light emitting element at a light emitting phase to drive the organic light emitting element to emit light.

2. The pixel circuit of claim 1, wherein the threshold compensation module comprises a first transistor, and a threshold voltage of the first transistor is a first threshold voltage; and a potential difference between the first potential and the second potential at least comprises the first threshold voltage.

3. The pixel circuit of claim 2, wherein the threshold voltage of the drive transistor is a second threshold voltage; and a difference between the first threshold voltage and the second threshold voltage is within a preset range.

4. The pixel circuit of claim 3, wherein an active layer of the first transistor comprises a first channel, and an active layer of the drive transistor comprises a second channel; and a distance W between the first channel and the second channel satisfies that 2.5 micron (μm)≤W≤4.5 μm.

5. The pixel circuit of claim 1, wherein the threshold compensation module comprises a first transistor, and the data writing module comprises a second transistor;

a first electrode of the first transistor receives a first reset signal, a second electrode of the first transistor is electrically connected to the second plate of the storage capacitor, and a gate of the first transistor is electrically connected to an anode of the organic light emitting element;

a first electrode of the second transistor receives a data signal, a second electrode of the second transistor is electrically connected to the gate of the drive transistor and the first plate of the storage capacitor, and a gate of the second transistor receives a first scanning signal; and a first electrode of the drive transistor receives a power signal, a second electrode of the drive transistor is electrically connected to the anode of the organic light emitting element, and a cathode of the organic light emitting element receives a logic low-level signal.

6. The pixel circuit of claim 5, further comprising: a connection trace, wherein the connection trace is configured to connect the second transistor to the storage capacitor, and connect the first transistor to the storage capacitor;

a width L1 of the connection trace satisfies that 1.5 μm≤L1≤2.5 μm;

a maximum extension length of a vertical projection of the first transistor on a reference plane is L2, wherein L2≤3 μm, and the reference plane is parallel to a plane in which the active layer of the first transistor is located; and a maximum extension length of a vertical projection of the second transistor on the reference plane is L3, wherein L3≤3 μm.

7. The pixel circuit of claim 1, wherein the first plate of the storage capacitor reuses the gate of the drive transistor.

8. A drive method of a pixel circuit, which is applied to a pixel circuit, wherein the pixel circuit comprises:

a drive transistor, a storage capacitor, a data writing module, a threshold compensation module, and an organic light emitting element; wherein the data writing module is electrically connected to a gate of the drive transistor and a first plate of the storage capacitor, and is configured to write a data signal to the gate of the drive transistor and the first plate of the storage capacitor at a data writing phase;

the threshold compensation module is electrically connected to a second plate of the storage capacitor, and is configured to adjust a potential of the second plate of the storage capacitor to a first potential at the data writing phase, and adjust the potential of the second plate of the storage capacitor to a second potential at a threshold compensation phase, so that a potential of the first plate of the storage capacitor is adjusted to a third potential and a threshold voltage of the drive transistor is compensated, wherein the second potential is greater than the first potential; and the drive transistor is electrically connected to the organic light emitting element, and is configured to provide a drive current to the organic light emitting element at a light emitting phase to drive the organic light emitting element to emit light;

wherein the method comprises:

at a data writing phase, writing, by a data writing module, data signals to each of a gate of a drive transistor and a first plate of a storage capacitor, and adjusting, by a threshold compensation module, a potential of a second plate of the storage capacitor to a first potential;

at a threshold compensation phase, adjusting, by the threshold compensation module, the potential of the second plate of the storage capacitor to a second potential, so that the potential of the second plate of the storage capacitor is raised to the second potential and a threshold voltage of the drive transistor is compensated, wherein the second potential is greater than the first potential; and at a light emitting phase, providing, by the drive transistor, a drive current to the organic light emitting element to drive the organic light emitting element to emit light.

9. The drive method of claim 8, wherein the threshold compensation module comprises:

a first transistor, and the data writing module comprises a second transistor;

a first electrode of the first transistor receives a first reset signal, a second electrode of the first transistor is electrically connected to a first plate of the storage capacitor, and a gate of the first transistor is electrically connected to an anode of the organic light emitting element;

a first electrode of the second transistor receives a data signal, a second electrode of the second transistor is electrically connected to the gate of the drive transistor and the second plate of the storage capacitor, and a gate of the second transistor receives a first scanning signal; and a first electrode of the drive transistor receives a power signal, a second electrode of the drive transistor is electrically connected to the anode of the organic light emitting element, and a cathode of the organic light emitting element receives a logic low-level signal;

wherein the data writing phase specifically comprises that: the first transistor and the second transistor are turned on, the data signal is written into the gate of the drive transistor and the first plate of the storage capacitor through the second transistor, and the first reset signal pulls down the potential of the second plate of the storage capacitor to a first potential through the first transistor, so that a voltage difference is generated between the first plate and the second plate of the storage capacitor;

wherein the threshold compensation phase specifically comprises that: the first transistor is turned on, the second transistor is turned off, the first reset signal is written into the second plate of the storage capacitor through the first transistor, and the potential of the second plate of the storage capacitor is adjusted to the second potential, wherein the second potential is greater than the first potential, so that the potential of the first plate of the storage capacitor is pulled up.

10. A display panel, comprising a display region and a non-display region surrounding the display region, wherein the display region at least comprises a first display region, the first display region comprises a plurality of first pixel circuits arranged in an array, and each of the plurality of first pixel circuits comprises:

a drive transistor, a storage capacitor, a data writing module, a threshold compensation module, and an organic light emitting element; wherein the data writing module is electrically connected to a gate of the drive transistor and a first plate of the storage capacitor, and is configured to write a data signal to the gate of the drive transistor and the first plate of the storage capacitor at a data writing phase;

the threshold compensation module is electrically connected to a second plate of the storage capacitor, and is configured to adjust a potential of the second plate of the storage capacitor to a first potential at the data writing phase, and adjust the potential of the second plate of the storage capacitor to a second potential at a threshold compensation phase, so that a potential of the first plate of the storage capacitor is adjusted to a third potential and a threshold voltage of the drive transistor is compensated, wherein the second potential is greater than the first potential; and the drive transistor is electrically connected to the organic light emitting element, and is configured to provide a drive current to the organic light emitting element at a light emitting phase to drive the organic light emitting element to emit light.

11. The display panel of claim 10, wherein the display region further comprises a plurality of first scanning signal lines, a plurality of first reset signal lines, a plurality of data signal lines and a plurality of power signal lines, and the non-display region comprises a plurality of cascaded first scan drive circuits, a plurality of cascaded first reset drive circuits and an integrated drive circuit;

the first pixel circuits in a same row share one of the plurality of first scanning signal lines and one of the plurality of first reset signal lines, and the first pixel circuits in a same column share one of the plurality of data signal lines and one of the plurality of power signal lines;

wherein an output terminal of the first scan drive circuit is electrically connected to the first scanning signal line, and is configured to provide a first scanning signal and transmit the first scanning signal to the first pixel circuit through the first scanning signal line;

an output terminal of the first reset drive circuit is electrically connected to the first reset signal line, and is configured to provide a first reset signal and transmit the first reset signal to the first pixel circuit through the first reset signal line; and a data signal output terminal of the integrated drive circuit is electrically connected to the data signal line, and is configured to provide a data signal to the data signal line and transmit the data signal to the first pixel circuit through the data signal line, and a power signal output terminal of the integrated drive circuit is electrically connected to the power signal line, and is configured to provide a power signal to the power signal line and transmit the power signal to the first pixel circuit through the power signal line.

12. The display panel of claim 11, wherein the first scan drive circuit is disposed in a first non-display region, and the first reset drive circuit is disposed in a second non-display region; and the first non-display region and the second non-display region are located on two opposite sides of the display region.

13. The display panel of claim 11, wherein the display region further comprises a second display region, wherein the second display region comprises a plurality of second pixel circuits arranged in an array, and a coverage area of the second pixel circuit is greater than a coverage area of the first pixel circuit.

14. The display panel of claim 13, wherein the second display region further comprises a plurality of second scanning signal lines, a plurality of third scanning signal lines, a plurality of second reset signal lines, a plurality of data signal lines and a plurality of power signal lines, and the non-display region further comprises a plurality of cascaded second scan drive circuits and a reset signal bus;

the second pixel circuits in a same row share one of the plurality of second scanning signal lines, one of the plurality of third scanning signal lines and one of the plurality of second reset signal lines, and the first pixel circuits and the second pixel circuits in a same column share one of the plurality of data signal lines and one of the plurality of power signal lines;

wherein an output terminal of the second scan drive circuit is electrically connected to the second scanning signal line and/or the third scanning signal line; the second scan drive circuit electrically connected to the second scanning signal line is configured to provide a second scanning signal and transmit the second scanning signal to the second pixel circuit through the second scanning signal line; the second scan drive circuit electrically connected to the third scanning signal line is configured to provide a third scanning signal and transmit the third scanning signal to the second pixel circuit through the third scanning signal line;

a reset signal output terminal of the integrated drive circuit is electrically connected to the second reset signal line through the reset signal bus, and the integrated drive circuit is further configured to provide a second reset signal and transmit the second reset signal to the second pixel circuit through the reset signal bus and the second reset signal line sequentially; and the integrated drive circuit is further configured to transmit the data signal to the second pixel circuit through the data signal line.

15. The display panel of claim 14, wherein the second scan drive circuit is reused as the first scan drive circuit; and the second scanning signal line or the third scanning signal line is reused as the first scanning signal line.

16. The display panel of claim 14, wherein the non-display region further comprises a conversion circuit;

wherein the conversion circuit is electrically connected between the second scan drive circuit and the first reset signal line, and is electrically connected between the reset signal bus and the first reset signal line; the conversion circuit is configured to convert the second reset signal provided by the reset signal bus into a first reset signal at a data writing phase, and convert the second scanning signal or the third scanning signal provided by the second scan drive circuit into a first reset signal at the threshold compensation phase.

17. The display panel of claim 16, wherein the conversion circuit comprises a fourth transistor, a fifth transistor and a first capacitor;

wherein a first electrode of the fourth transistor is electrically connected to the reset signal bus, a second electrode of the fourth transistor is electrically connected to the first reset signal line, and a gate of the fourth transistor is electrically connected to the output terminal of the second scan drive circuit through the second scanning signal line;

a first electrode of the fifth transistor is electrically connected to the output terminal of the second scan drive circuit through the second scanning signal line, a second electrode of the fifth transistor is electrically connected to the first reset signal line, and a gate of the fifth transistor is electrically connected to the output terminal of the second scan drive circuit through the third scanning signal line;

a first plate of the first capacitor is electrically connected to the first reset signal line, and a second plate of the first capacitor is electrically connected to a fixed potential signal line.

18. The display panel of claim 17, wherein the fixed potential is reused as the power signal.

19. The display panel of claim 13, wherein a number of first pixel circuits per unit area in the first display region is the same as a number of second pixel circuits per unit area in the second display region; and the first display region is reused as a sensor setting region.

20. A display device, comprising the display panel of claim 10.

* * * * *